US009169691B2

(12) United States Patent
Berger

(10) Patent No.: US 9,169,691 B2
(45) **Date of Patent: *Oct. 27, 2015**

(54) MAGNETIC TILT AND RAISE/LOWER MECHANISMS FOR A VENETIAN BLIND

(71) Applicant: Masonite Corporation, Tampa, FL (US)

(72) Inventor: David Barry Berger, Toronto (CA)

(73) Assignee: Masonite Corporation, Tampa, FL (US)

( * ) Notice: Subject to any disclaimer, the term of this patent is extended or adjusted under 35 U.S.C. 154(b) by 36 days.

This patent is subject to a terminal disclaimer.

(21) Appl. No.: 14/109,523

(22) Filed: Dec. 17, 2013

(65) Prior Publication Data

US 2014/0182794 A1 Jul. 3, 2014

Related U.S. Application Data

(60) Continuation of application No. 13/602,442, filed on Sep. 4, 2012, now Pat. No. 8,607,839, which is a continuation of application No. 12/714,760, filed on Mar. 1, 2010, now Pat. No. 8,256,489, which is a (Continued)

(51) Int. Cl.

| | |
|---|---|
| ***E06B 9/30*** | (2006.01) |
| ***E06B 9/38*** | (2006.01) |
| ***E06B 9/264*** | (2006.01) |
| ***E06B 9/32*** | (2006.01) |
| ***E06B 3/04*** | (2006.01) |

(52) U.S. Cl.

CPC ... *E06B 9/38* (2013.01); *E06B 3/04* (2013.01); *E06B 9/264* (2013.01); *E06B 9/30* (2013.01); *E06B 9/32* (2013.01); *E06B 2009/2646* (2013.01)

(58) Field of Classification Search

CPC ..... E06B 9/264

USPC ..... 160/107, 84.04, 84.05, 168.1 R, 170, 160/173 R, 176.1 R, 178.1 R, 17, 7 R

See application file for complete search history.

(56) References Cited

U.S. PATENT DOCUMENTS

| | | | |
|---|---|---|---|
| 1,486,962 | A | 3/1924 | Heintz |
| 2,389,956 | A | 11/1945 | Castilonia |
| 3,123,351 | A | 3/1964 | Graber |

(Continued)

FOREIGN PATENT DOCUMENTS

| | | | |
|---|---|---|---|
| EP | 0082723 | A1 | 6/1983 |
| JP | 07-091153 | | 4/1995 |

(Continued)

*Primary Examiner* — Blair M Johnson

(74) *Attorney, Agent, or Firm* — Berenato & White, LLC

(57) ABSTRACT

The present invention discloses a window blind within a multi-pane window. A window blind disposed between first and second panes includes a plurality of slats. Raise/lower and tilt lines are coupled to the slats. A carriage housing is disposed between the panes proximate a side edge thereof. A tilt strip is disposed within the carriage housing and coupled to the tilt lines. An inner carriage disposed within the carriage housing includes an upper portion coupled to the raise/lower lines to actuate raising and lowering the slats, and a lower portion coupled to the tilt strip to actuate tilting the slats. An external carriage is adjacent the exterior surface and aligned with and magnetically coupled to the inner carriage. The external carriage is linearly movable to move the inner carriage. A method of adjusting a window blind within a multi-pane window is also disclosed.

18 Claims, 19 Drawing Sheets

Related U.S. Application Data division of application No. 11/522,473, filed on Sep. 18, 2006, now Pat. No. 7,669,633, which is a continuation-in-part of application No. 10/784,131, filed on Feb. 19, 2004, now Pat. No. 7,337,824.

(60) Provisional application No. 60/447,688, filed on Feb. 19, 2003, provisional application No. 60/466,057, filed on Apr. 29, 2003.

(56) References Cited

U.S. PATENT DOCUMENTS

| | | | |
|---|---|---|---|
| 3,129,471 | A | 4/1964 | Johnson et al. |
| 3,201,832 | A | 8/1965 | Hordis et al. |
| 3,253,644 | A | 5/1966 | Gotoh et al. |
| 3,392,420 | A | 7/1968 | Kless |
| 3,722,572 | A | 3/1973 | Hall |
| 3,945,264 | A | 3/1976 | Falkenberg |
| 4,480,674 | A | 11/1984 | Anderson |
| 4,588,012 | A | 5/1986 | Anderson |
| 4,611,648 | A | 9/1986 | Anderson |
| 4,684,911 | A | 8/1987 | Streeter |
| 4,685,502 | A | 8/1987 | Spangenberg |
| 4,702,296 | A | 10/1987 | Anderson |
| 4,723,586 | A | 2/1988 | Spangenberg |
| 4,768,576 | A | 9/1988 | Anderson |
| 4,817,698 | A | 4/1989 | Rossini et al. |
| 5,396,944 | A | 3/1995 | Rossini |
| 5,699,845 | A | 12/1997 | Jelic |
| 5,718,274 | A | 2/1998 | Streeter |
| 5,769,142 | A | 6/1998 | Nicolosi |
| RE35,926 | E | 10/1998 | Hagen |
| 5,826,638 | A | 10/1998 | Jelic |
| 5,904,198 | A | 5/1999 | Huang |
| 5,996,668 | A | 12/1999 | DeBlock et al. |
| 6,059,006 | A | 5/2000 | Rossini |
| 6,065,524 | A | 5/2000 | Rossini |
| 6,095,223 | A | 8/2000 | Rossini et al. |
| 6,272,811 | B1 | 8/2001 | Hagen |
| 6,328,090 | B1 | 12/2001 | Anderson et al. |
| 6,332,491 | B1 | 12/2001 | Rossini |
| 6,401,790 | B1 | 6/2002 | Dai et al. |
| 6,601,633 | B2 | 8/2003 | Sun et al. |
| 6,736,185 | B2 | 5/2004 | Smith et al. |
| 6,817,401 | B2 | 11/2004 | Sun et al. |
| 6,854,503 | B2 | 2/2005 | Cross et al. |
| 6,932,139 | B2 | 8/2005 | Early et al. |
| 7,000,670 | B2 | 2/2006 | Kwon et al. |
| 7,337,824 | B2 | 3/2008 | Berger |
| 7,640,964 | B2 | 1/2010 | Berger |
| 7,669,633 | B2 | 3/2010 | Berger |
| 8,256,489 | B2 | 9/2012 | Berger |
| 8,607,839 | B2 * | 12/2013 | Berger ..... 160/107 |
| 2003/0075285 | A1 | 4/2003 | Anderson et al. |
| 2003/0173036 | A1 | 9/2003 | Kwon et al. |
| 2003/0192656 | A1 | 10/2003 | Burgess |
| 2004/0211528 | A1 | 10/2004 | Jin et al. |
| 2004/0226665 | A1 | 11/2004 | Berger |
| 2006/0118250 | A1 | 6/2006 | Jin et al. |
| 2007/0017644 | A1 | 1/2007 | Berger |
| 2008/0179018 | A1 | 7/2008 | Berger |
| 2010/0243177 | A1 | 9/2010 | Berger |

FOREIGN PATENT DOCUMENTS

| | | |
|---|---|---|
| JP | 08-013957 | 1/1996 |
| JP | 8-86167 | 4/1996 |
| JP | 8-165867 | 6/1996 |
| WO | 01/27431 A1 | 4/2001 |

* cited by examiner 60a
76
74
20
21
22

83
24
72
21

2C
66
60B
86
76
74
21
24a
21
22

66
2B
62
2A
18
2D
32
10
16
26
24a
24

2E
39
38
2F 32
33

Fig. 4
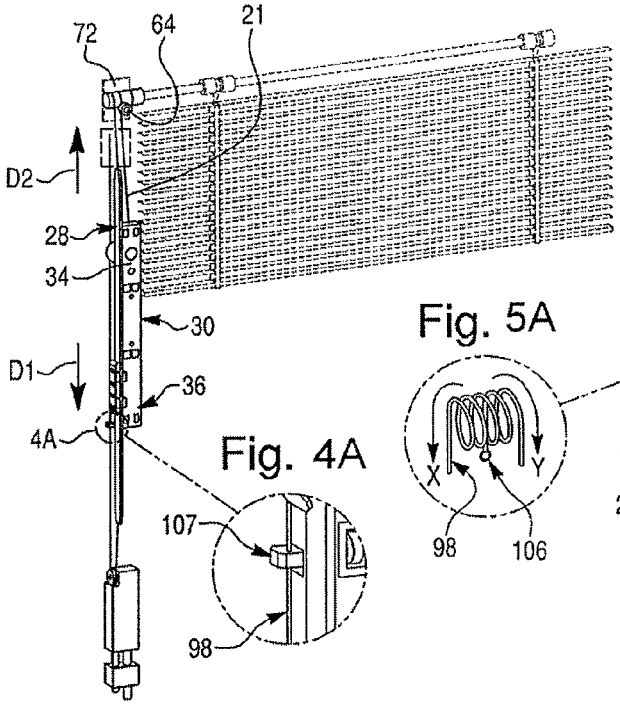
Fig. 4A
Fig. 5A
Fig. 5
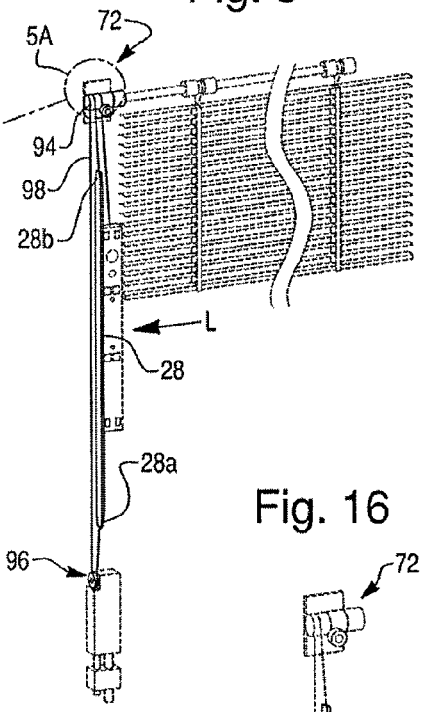
Fig. 4B
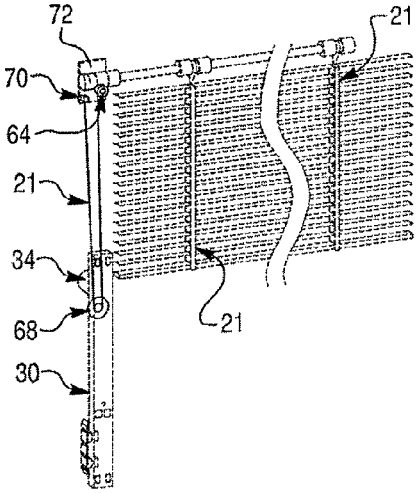
Fig. 16
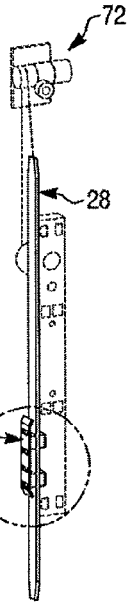
Fig. 16A
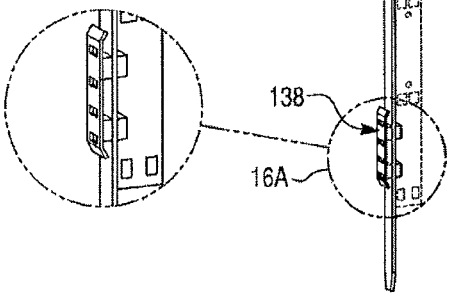

400a
98
D2
32
402
RL
M
D1
CL
28B
T
406A
32C
108
307
414
406
32E
138B
416
418

MAGNETIC TILT AND RAISE/LOWER MECHANISMS FOR A VENETIAN BLIND

CROSS-REFERENCE TO RELATED APPLICATIONS AND CLAIM TO PRIORITY

This application is a continuation of application Ser. No. 13/602,442 filed on Sep. 4, 2012, now U.S. Pat. No. 8,607,839, which is a continuation of application Ser. No. 12/714,760 filed on Mar. 1, 2010, now U.S. Pat. No. 8,256,489, which is a divisional of Ser. No. 11/522,473 filed on Sep. 18, 2006, now U.S. Pat. No. 7,669,633, which is a continuation-in-part of application Ser. No. 10/784,131, filed Feb. 19, 2004, now U.S. Pat. No. 7,337,824, which is based on and claims the benefit of priority of provisional patent application Ser. No. 60/447,688, filed Feb. 19, 2003, and provisional patent application Ser. No. 60/466,057, filed Apr. 29, 2003, the disclosures of which are incorporated herein by reference and to which priority is claimed under 35 U.S.C. §§119 and 120.

FIELD OF THE INVENTION

The present invention discloses a window blind within a multi-pane window. A window blind disposed between first and second panes includes a plurality of slats. Raise/lower and tilt lines are coupled to the slats. A carriage housing is disposed between the panes proximate a side edge thereof. A tilt strip is disposed within the carriage housing and coupled to the tilt lines. An inner carriage disposed within the carriage housing, includes an upper portion coupled to the raise/lower lines to actuate raising and lowering the slats, and a lower portion coupled to the tilt strip to actuate tilting the slats. An external carriage is adjacent the exterior surface and aligned with and magnetically coupled to the inner carriage. The external carriage is linearly movable to move the inner carriage. A method of adjusting a window blind within a multi-pane window is also disclosed.

BACKGROUND OF THE INVENTION

Various designs for Venetian blinds within multi-pane windows have been developed. Such blinds may include a mechanism for raising and lowering the slats of the blind, which is typically provided along a side edge of the window, and a separate mechanism for tilting the slats, which is typically provided along a top edge of the window.

Some conventional designs include external magnets that are magnetically coupled to internal lift and tilt carriages. The external magnets run along the exterior surface of the glass panes and move the inner tilt and/or lift carriages as a result of the magnetic coupling therebetween. Movement of the tilt carriage moves tilt lines or a tilt ladder causing the slats of the blind to tilt and thereby open or close. Movement of the lift carriage moves the raise/lower lines of the blind causing the blind to raise or lower.

U.S. Pat. No. 5,826,638 to Jelic discloses a tilt mechanism for a venetian blind disposed between the glass panes of a double-glazed window. The tilting mechanism comprises an internal magnet located between the glass panes and an external magnet for moving the internal magnet. The internal magnet is coupled to a tilt assembly. The tilt assembly includes a shaft that extends across the width of the venetian blind. The shaft is coupled to a tilt ladder, which supports the slats of the venetian blind. The internal magnet is coupled to a nut that is mounted on a threaded rod. Linear movement of the nut in response to movement of the internal magnet causes the threaded rod to rotate, which in turn imparts rotation of the shaft thereby to open or close the venetian blind.

Various problems exist with such conventional designs. The external magnets of many such designs are abrasive against the glass pane. As such, movement of the external magnets over the glass panes often results in scratching and marking of the glass panes after extended use, rendering the window aesthetically unappealing. In addition, a significant amount of force is required to overcome the coefficient of static friction between the external magnets and the glass panes when the internal mechanisms are actuated. This may result in an operator applying excessive forces to the external magnets, which may break the magnetic union between the external magnets and the internal tilt and/or lift mechanisms.

In addition, conventional designs provide for two separate sliding knobs or control elements. It would be desirable to provide a single, external control element to accomplish the dual functions of (a) raising and lowering the slats and (b) adjusting the tilt of the slats.

SUMMARY OF THE INVENTION

The present invention is directed to a window blind within a multi-pane window having a single control element which accomplishes the dual functions of (a) raising and lowering the blind, and (b) adjusting the tilt of the blind slats. The dual function control element includes at least one moveable internal carriage which cooperates with at least one external slide knob. Multiple inner carriages may operate with at least one external slide knob. Various combinations of single and multiple inner and outer carriages may be employed to facilitate the raise, lower and tilt adjustments, to suit particular requirements. The internal carriage assembly is sealed between two glass panels, with a rigid outer frame affixed around the perimeter of the multi-pane unit.

The present invention discloses a window blind within a multi-pane window. A multi-pane window has first and second spaced panes defining an interior space, and an exterior surface. A window blind is disposed within the interior space and includes a plurality of slats. Raise/lower lines are coupled to the slats. Tilt lines are coupled to the slats. A carriage housing is disposed within the interior space proximate a side edge of the multi-pane window. A tilt strip is disposed within the carriage housing and coupled to the tilt lines. A first inner carriage is disposed within the carriage housing. The first inner carriage is coupled to the tilt strip to actuate upwardly tilting the slats when moved in a first direction and downwardly tilting the slats when moved in a second direction. The first inner carriage includes a first inner carriage magnet. A second inner carriage is also disposed within the carriage housing, and coupled to the raise/lower lines to actuate raising the slats when moved in the first direction and lowering the slats when moved in the second direction. The second inner carriage includes a second inner carriage magnet. A first external magnet is provided, which is adjacent the exterior surface and aligned with and magnetically coupled to the first inner carriage magnet. The first external magnet is linearly moveable to move the first inner carriage. A second external magnet is adjacent the exterior surface and aligned with and magnetically coupled to the second inner carriage magnet. The second external magnet is linearly moveable to move the second inner carriage.

A window blind within a multi-pane window according to another embodiment is also disclosed. A multi-pane window has first and second spaced panes defining an interior space and an exterior surface. The window blind includes a plurality of slats disposed within the interior space. Raise/lower lines and tilt lines are coupled to the slats. A carriage housing is disposed within the interior space proximate a side edge of the multi-pane window. A tilt strip is disposed within the carriage housing and coupled to the tilt lines. An inner carriage is disposed within the carriage housing. The inner carriage has a lower portion, an upper portion, and an inner magnet. The lower portion is coupled to the tilt strip to actuate upwardly tilting the slats when moved in a first direction and downwardly tilting the slats when moved in a second direction. The upper portion is coupled to the raise/lower lines to actuate raising the slats when moved in the first direction and lowering the slats when moved in the second direction. An external carriage is provided, which is adjacent the exterior surface and aligned with and magnetically coupled to the inner magnet. The external carriage is linearly moveable to move the inner carriage in the first and second directions.

Also disclosed is a method of adjusting a window blind within a multi-pane window. A multi-pane window is provided having first and second spaced panes defining an interior space and an exterior surface, and a window blind including a plurality of slats disposed within the interior space. A control mechanism is provided proximate a side edge of the multi-pane window. In the case of a two part inner carriage, operating with an outer slide knob, the control mechanism has an inner carriage having a first portion for raising and lowering the slats and a second portion for adjusting the tilt of the slats. An outer slide knob is magnetically coupled to the inner carriage. When the slide knob is linearly moved a first distance in a first direction, the second portion of the inner carriage is moved, thereby adjusting the tilt of the slats. When the slide knob is moved a second distance in the first direction, both the first and second portions of the inner carriage are moved, thereby raising the slats.

BRIEF DESCRIPTION OF THE FIGURES

FIG. 4 is a perspective view of components of a raise/lower and tilt control mechanism according to an embodiment, with portions of the assembly shown in phantom;

FIG. 4A is a detail view of circled portion 4A in FIG. 4;

FIG. 4B is a perspective view showing the raise/lower lines, with portions of the assembly shown in phantom;

FIG. 5 is a perspective view shoving the tilt strip and pulley lines forming a closed loop, with portions of the assembly shown in phantom;

FIG. 5A is as detail view of circled portion 5A in FIG. 5;

FIG. 16 is a perspective view of a tilt bar and gripping magnets, with portion of the assembly shown in phantom;

FIG. 16A is a detail view of circled portion 16A in FIG. 16;

DETAILED DESCRIPTION OF THE INVENTION

Figure 1:
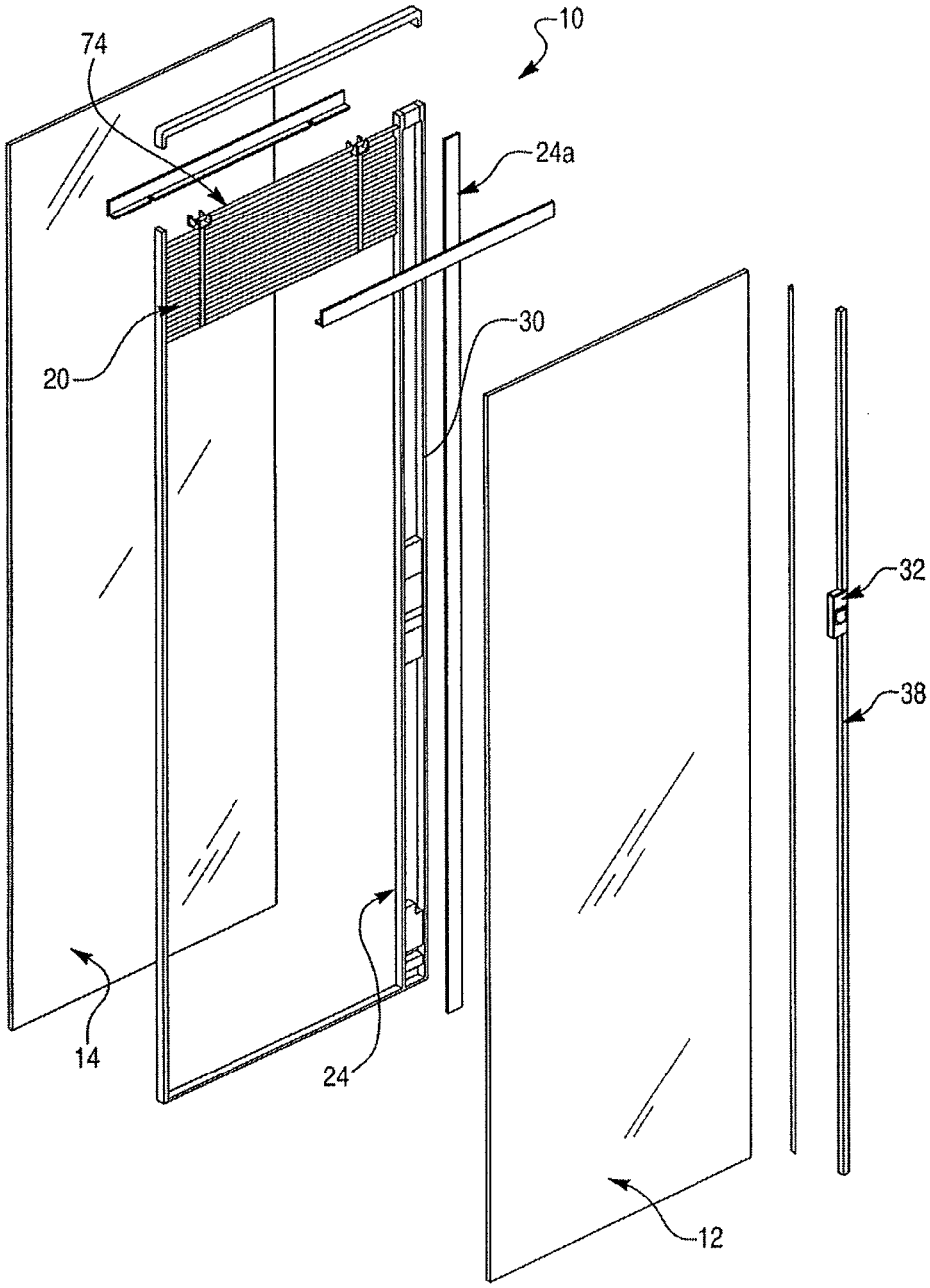
FIG. 1 is a perspective partially exploded view of a window blind assembly according to an embodiment of the present invention.
Figures 2, 2A, 2B, 2C, 2D, 2E, 2F:
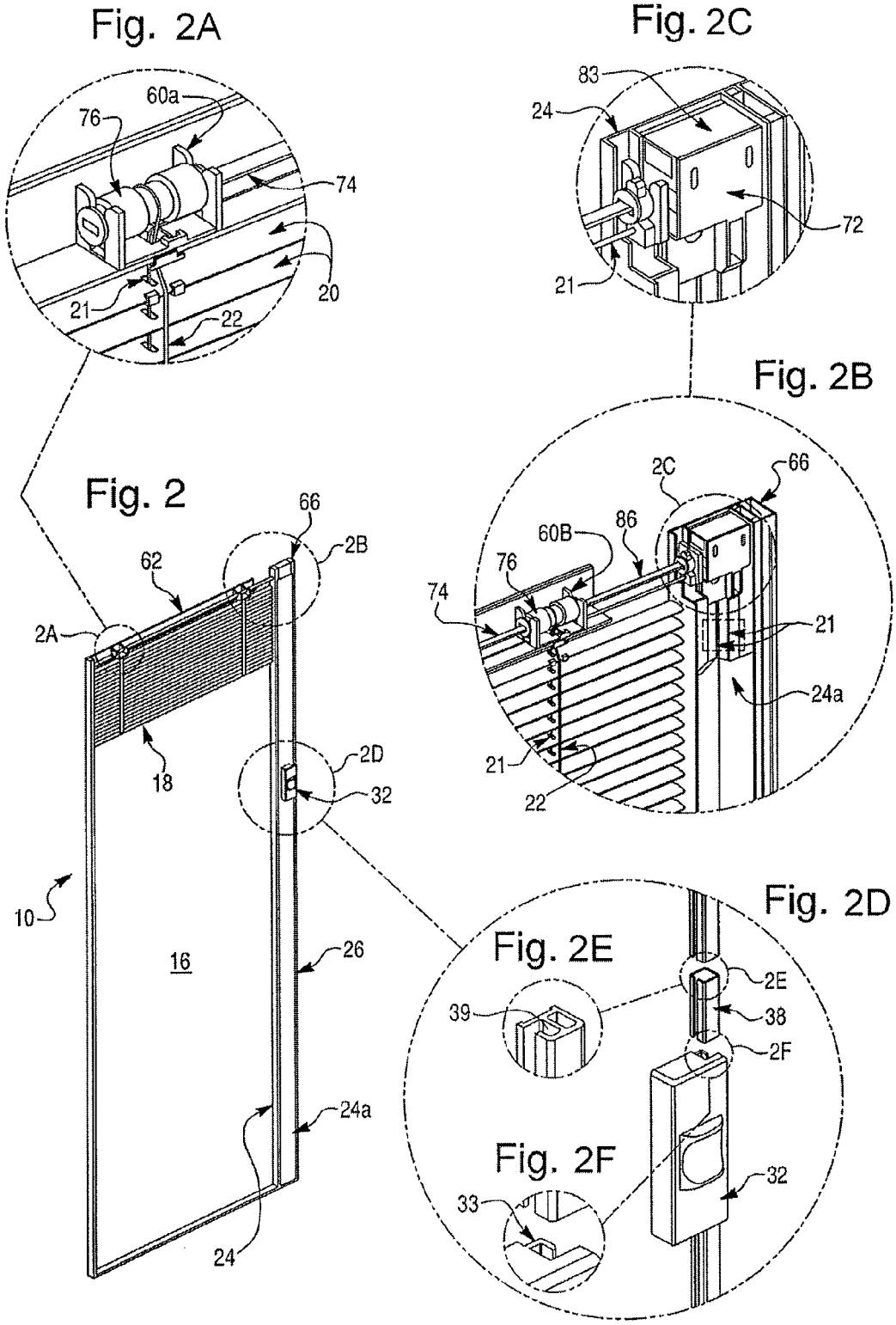
FIG. 2 is a perspective view of a number of components of the window blind assembly of FIG. 1.
FIG. 2A is a detail view of circled portion 2A in FIG. 2.
FIG. 2B is a detail view of circled portion 2B in FIG. 2.
FIG. 2C is a detail view of circled portion 2C in FIG. 2B.
FIG. 2D is a detail view of circled portion 2D in FIG. 2.
FIG. 2E is a detail view of circled portion 2E in FIG. 2D.
FIG. 2F is a detail view of circled portion 2F in FIG. 2D.

A window blind assembly 10 according to the present invention is best shown in FIGS. 1 and 2. Assembly 10 includes a multi-pane window having first and second spaced panes 12, 14 defining an interior space, and an exterior surface 16. A window blind 18 including a plurality of slats 20 is disposed within the interior space between panes 12, 14. Raise/lower lines 21 and tilt lines 22 are coupled to slats 20, as best shown in FIGS. 2A and 2B.

Figure 6:
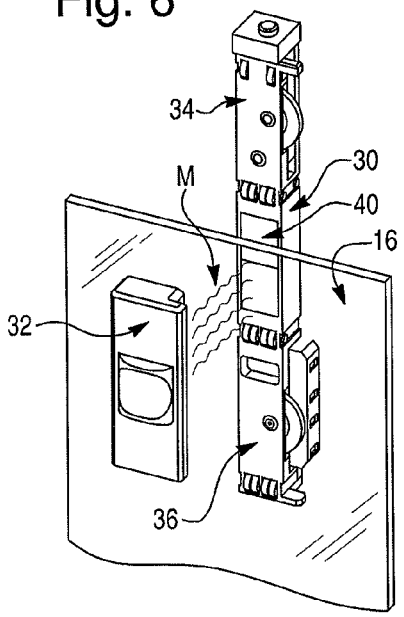
FIG. 6 is a perspective view of an inner carriage, coupled to an external carriage, shown in phantom, and a fragmentary view of one of the glass panes.

As best shown in FIGS. 2, 3, 3A and 3B, a dual component carriage housing 24 with cover strip 24*a*, is disposed between panes 12, 14 within the interior space and proximate a side edge 26 of assembly 10. As best shown in FIGS. 4 and 5, a tilt strip 28 is disposed within carriage housing 24 and coupled to tilt lines 22, which is explained more fully below. Tilt strip 28 imparts linear tensile forces to tilt lines 22. As best shown in FIGS. 1, 2, and 6, an inner carriage 30 is disposed within carriage housing 24, and an external carriage 32 is adjacent exterior surface 16 and aligned with and magnetically coupled to inner carriage 30, as shown by lines M in FIG. 6.

As best shown in FIGS. 4, 4B and 6, inner carriage 30 has an upper portion 34 coupled to raise/lower line couplet 21 to actuate raising slats 20 when moved in a first direction shown by arrow D1, and lowering slats 20 when moved in a second direction shown by arrow D2. Inner carriage 30 also includes a lower portion 36 coupled to tilt strip 28 to actuate upwardly tilting slats 20 when moved in first direction D1 and downwardly tilting slats 20 when moved in second direction D2. External carriage 32 is linearly movable to move inner carriage 30.

As best shown in FIGS. 1, 2D, 2E and 2F, a guide track 38 may be provided on exterior surface 16 along side edge 26 and parallel to carriage housing 24. Exterior carriage 32 is configured to engage guide track 38 and is slidably secured thereto. For example, exterior carriage 32 may include a flange 33 extending outwardly from and parallel to a longitudinal side thereof, which engages a recess 39 provided in guide track 38. Exterior carriage 32 is linearly moveable along guide track 38 in first and second directions D1, D2.

Figure 8:
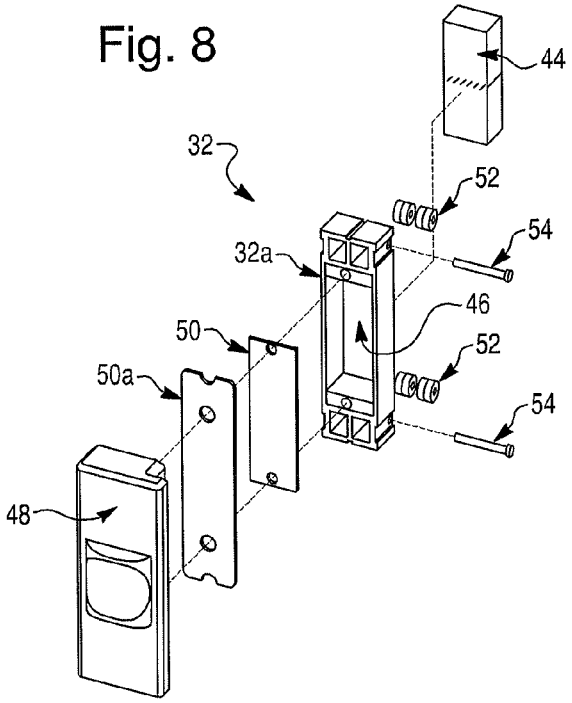
FIG. 8 is an exploded view of an external carriage and slide knob assembly according to an embodiment of the present invention.
Figure 7:
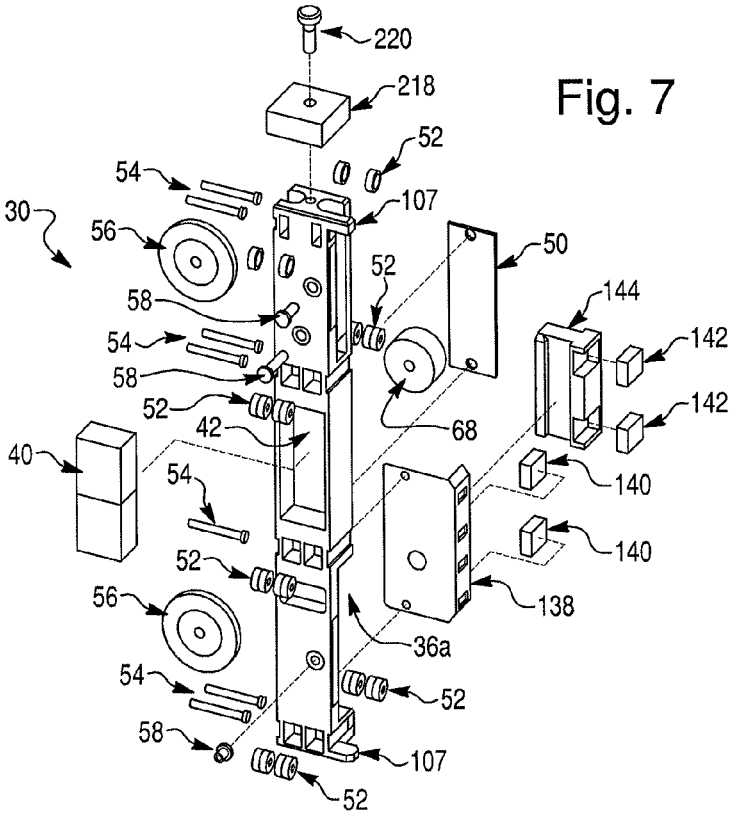
FIG. 7 is an exploded view of the inner carriage of FIG. 6.

As best shown in FIGS. 6, 7 and 8, inner carriage 30 may include a first inner carriage magnet 40 disposed within a central magnet chamber 42 intermediate upper portion 34 and lower portion 36. Upper and lower portions 34, 36 and central magnet chamber 42 may be integrally formed. External carriage 32 includes a first external carriage magnet 44 disposed within an external magnet chamber 46 and magnetically coupled to first inner carriage magnet 40, as shown by lines M in FIG. 6. External carriage 32 preferably includes an externally disposed slide knob 48, which is configured to be gripped by a user during operation. Cover plate 50 may be provided for retaining first external carriage magnet 44 in place within external magnet chamber 46 in external carriage frame 32*a*. Adhesive pad 50*a* is provided for tightly securing slide knob 48 to external carriage frame 32*a* and cover plate 50. However, it would be understood by one skilled in the art that other methods of securing slide knob 48 to external carriage frame 32*a* and cover plate 50 may be employed, such as using an adhesive glue or with fasteners.

Inner carriage 30 and/or external carriage 32 may include friction reducing elements disposed adjacent the corresponding surface of panes 12, 14 against which inner carriage 30 and/or external carriage 32 moves in order to minimize friction, as described more fully in co-pending application Ser. No. 10/784,131. For example, inner carriage 30 and/or external carriage 32 may include a wheel set, a contact pad, a roller, ball bearings, or a friction reducing coating in order to facilitate frictionless movement. As shown in FIGS. 6-8, a plurality of rollers 52 are rotatably secured to inner carriage 30 via roller shafts 54. Rollers 52 facilitate linear movement of inner carriage 30 as it travels within carriage housing 24, providing a smooth, relatively frictionless movement therein. Inner carriage 30 may also include guide wheels 56 rotatably secured adjacent opposite ends thereof via cooperating fasteners 58, 58A. Guide wheels 56 also facilitate smooth linear movement of inner carriage 30 within carriage housing 24. Rollers 52 may likewise be secured to external carriage 32 via roller shafts 54, facilitating relatively frictionless movement of external carriage 32 as it travels along exterior surface 16 and concurrently engaged to guide track 38. A wiper/bumper pad 218 may be secured to an upper end 34*a* of upper portion 34 via an associated retaining screw 220. Wiper/bumper pad 218 confines the lift lines 21 above the inner carriage 30 to prevent entanglement of these lines with any rolling and/or fixed elements of inner carriage 30. The wiper/bumper pad 218 also absorbs any impact that may be sustained between upper portion 34 and fixed pulley bracket 72 when inner carriage 30 is disposed at the uppermost position within carriage housing 24 and upper end 34*a* and fixed pulley bracket 72 converge and abut.

As best shown in FIGS. 2-2B, 3-3A, 4 and 4B, raise/lower lines 21 may be coupled to upper portion 34 of inner carriage 30 via a lift assembly, which preferably includes a pair of spaced cradles 60A, 60B disposed along a top edge 62 of assembly 10, and a fixed pulley 64 disposed proximate a corner 66 and proximate the convergence of side edge 26 and top edge 62. Raise/lower lines 21 may include one or more extension ends that are attached to the bottommost slat 20 in window blind 18, as known in the art, and extend from the bottommost slat through openings in slats 20 and pass through cradles 60A, 60B. From cradles 60A, 60B, raise/lower lines 21 extend along long top edge 62 to corner 66, around fixed pulley 64, and down along side edge 26 within carriage housing 24 to terminate at upper portion 34. As inner carriage 30 is moved downwardly in first direction D1 away from corner 66, raise/lower lines 21 pull slats 20 upwardly, thereby opening window blind 18. As inner carriage 30 is moved upwardly in second direction D2 toward corner 66, slats 20 pull raise/lower lines 21 downwardly, maintaining sufficient tension on raise/lower lines 21 due to the weight of slats 20, thereby closing window blind 18.

The lift assembly for raising and lowering slats 20 may also include a multiplier pulley, as described more fully in co-pending application Ser. No. 10/784,131, to increase the pull ratio of lift assembly. For example, a multiplier pulley 68 may be rotatably disposed on upper portion 34 of inner carriage 30, as best shown in FIG. 7. Raise/lower lines 21 loop around multiplier pulley 68, and extend back toward corner 66. The end of raise/lower lines 21 may be secured via an anchor ring 70 proximate fixed pulley 64, as shown in FIGS. 3A and 4B.

Figure 3:
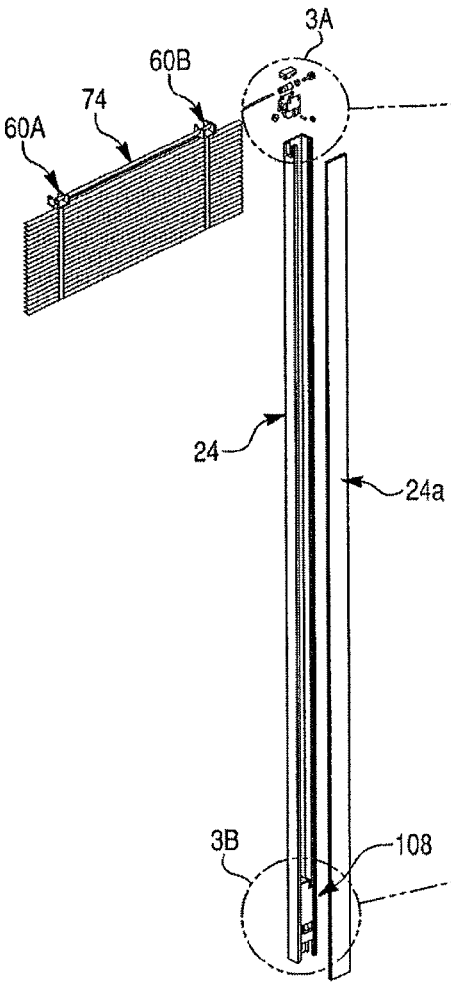
FIG. 3 is a perspective, partially exploded view of as number of components of the window blind assembly of FIG. 1.
Figure 3A:
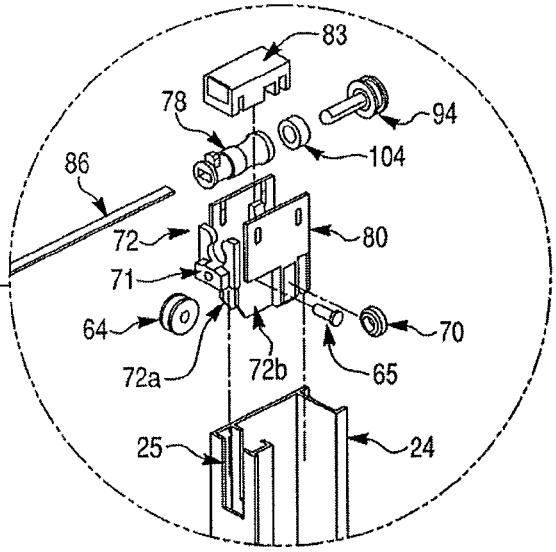
FIG. 3A is an exploded detail view of circled portion 3A of FIG. 3.
Figure 3B:
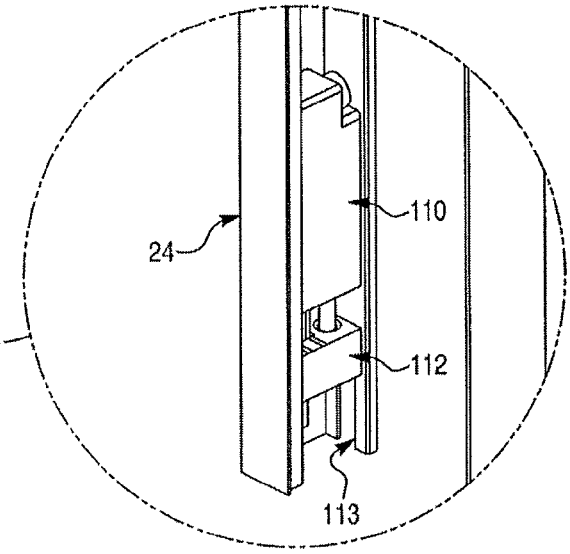
FIG. 3B is as detail view of circled portion 3B in FIG. 3.
Figure 9B:
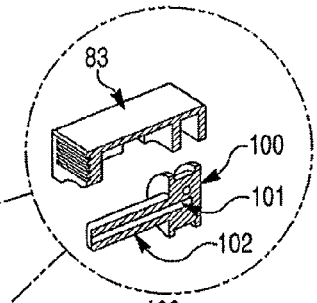
FIG. 9B is a sectional view of components identified in FIG. 9.
Figure 9:
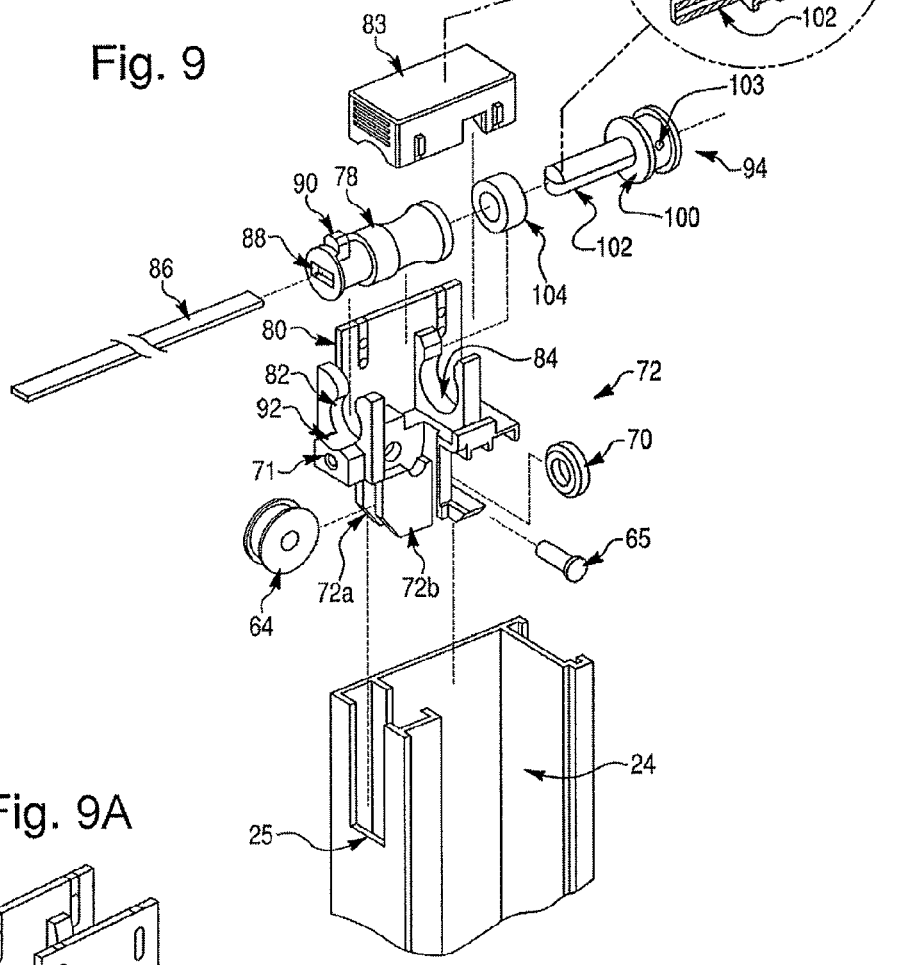
FIG. 9 is a fragmentary, exploded view of a fixed pulley bracket assembly.
Figure 9A:
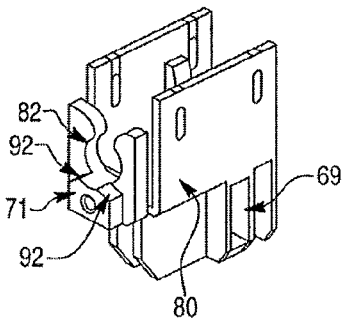
FIG. 9A is a perspective view of the fixed pulley bracket.

As best shown in FIGS. 2C, 3A, and 9, fixed pulley 64 and anchor ring 70 may be disposed on a fixed pulley bracket 72 secured to assembly 10 proximate corner 66. Fixed pulley 64 is rotatably secured to pulley bracket 72, intermediate pulley support ribs 72*a* and 72*b*, via an associated fastener 65. Pulley bracket 72 may also include a lower chamber 69 configured for receiving anchor ring 70, as best shown in FIG. 9A. Pulley bracket 72 may be retained and located axially at the top of carriage housing 24, proximate corner 66, by an upper retaining notch 25 formed on an inner face of carriage housing 24, and configured to receive a retaining boss 71 provided on pulley bracket 72.

Tilt lines 22 are preferably coupled to tilt strip 28 via a tilt assembly including a tilt rod 74 proximate top edge 62, as best shown in FIGS. 1, 2A, 2B and 3. A pair of tilt spools 76 are secured to opposite ends of tilt rod 74, and are rotatably received in correspondingly configured cradles 60A, 60B. Tilt lines 22 support slats 20, and have ends that extend upwardly and are secured to tilt spools 76, as known in the art. Concurrent rotation of tilt spools 76 in one direction causes slats 20 to tilt upwardly, while rotation of tilt spools 76 in the opposite direction causes slats 20 to tilt downwardly. A tilt drive spool 78 is disposed proximate corner 66. Preferably, fixed pulley bracket assembly 72 includes an integrally formed drive spool housing 80, as best shown in FIGS. 3A, 9 and 9A. Drive spool housing 80 includes first and second spaced cutouts 82 and 84, configured for receiving the front end of tilt drive spool 78, and bearing 104, which supports the rear portion of drive spool 78, so that tilt drive spool 78 is rotatably secured within drive spool housing 80. A retaining aver 83 may also be provided, which encloses tilt drive spool 78 within drive spool housing 80, as best shown in FIGS. 2C and 9 and 9B. Cutouts 82, 84 have a circular face to accommodate rotation of tilt drive spool 78. Tilt drive spool 78 is coupled to adjacent tilt spool 76 disposed within cradle 60B, and thus tilt rod 74, via a drive bar 86. Tilt drive spool 78 may include an end slot 88 in which a corresponding end of drive bar 86 is received. Drive bar 86 is preferably axially aligned with both tilt drive spool 78 and the adjacent tilt spool 76.

Tilt drive spool 78 is coupled to tilt strip 28 so that movement of tilt strip 28 rotates tilt drive spool 78, thereby transmitting rotational torque to tilt rod 74 via drive bar 86. Rotation of tilt rod 74, in turn, causes tilt spools 76 to rotate, thereby tilting slats 20. Movement of tilt strip 28 in first direction D1 causes tilt drive spool 78 to rotate in one direction, causing slats 20 to tilt upwardly. Movement of tilt strip 28 in second direction D2 causes tilt drive spool 78 to rotate in the opposite direction, causing slats 20 to tilt downwardly.

Tilt drive spool 78 preferably includes a rotation limiting stem 90 extending radially from an end thereof, and engageable with a contact face 92 disposed on pulley bracket 72, as best shown in FIGS. 9 and 9A. Contact face 92 may be provided proximate cutout 82, and integrally formed with retaining boss 71. Rotation of tilt drive spool 78 is restricted when rotation limiting stem 90 engages contact face 92. In this way, tilt drive spool 78 may only rotate to a predetermined angle, preferably subtending an angle of about 180°, so that tilt spools 76 rotate a sufficient angle to either fully tilt upward or fully tilt downward slats 20 (depending on the direction of rotation). However, tilt spools 76 are restricted from continued rotation once slats 20 have been fully tilted upward or downward.

Tilt drive spool 78 may be coupled to tilt strip 28 via first and second spaced tilt pulleys 94, 96 and a tilt pulley line 98, as best shown in FIG. 5. First tilt pulley 94 is connected to tilt drive spool 78, as best shown in FIG. 9. First tilt pulley 94 may include a body 100 with a slotted shaft 102 extending outwardly therefrom and receivable in a corresponding bore (not shown) in an end of tilt drive spool 78. A bearing element 104 may be disposed on shaft 102 and intermediate tilt drive spool 78 and body 100 when first tilt pulley 94 is attached thereto. End slot 88 preferably extends axially through tilt drive spool 78 and into the corresponding bore. Drive bar 86 imparts the rotational torque required to tilt slats 20, and preferably passes entirely through end slot 88 of tilt drive spool 78 and is received within slotted shaft 102, terminating against an inner face 101 within body 100 of first tilt pulley 94, as best shown in FIGS. 9 and 9B.

As best shown in FIGS. 4, 4B, 5 and 5A, fixed pulley bracket 72 therefore houses components having various functions, which (a) direct raise/lower lines 21 via fixed pulley 64, (b) house and retain tilt drive spool 78 and the associated rotational support components, and (c) house, direct and retain the wound ends of tilt pulley lines 98 on first tilt pulley 94.

Second tilt pulley 96 is disposed along side edge 26 (See FIG. 2), within carriage housing 24. First tilt pulley 94 may include a tilt line attachment bore 103 (See FIG. 9). Two ends, or a small folded segment of tilt pulley line(s) 98 passes through attachment bore 103, and is retained therein via a knot or associated clip 106. Consequently, there are two line segments that extend from first tilt pulley 94 downwardly toward inner carriage 30. These line segments are tightly wound around first tilt pulley 94 in opposite directions on either side of attachment bore 103, as best shown in FIG. 5A. Each winding is preferably in the order of two or more revolutions, and both line segments point downward. It should be understood however that the particular direction and orientation of the windings is determined by the application.

With both line segments pointing downward, a downward pull on one of the line segments will cause first tilt pulley 94 to rotate in one direction, while a downward pull on the other line segment will cause first tilt pulley 94 to rotate in the opposite direction, as shown by arrows X and Y in FIG. 5A. One of the line segments continues downward through carriage housing 24, and may pass through associated bores or arms in one or more tilt line guide arms 107 disposed on opposite ends of inner carriage 30, as shown in FIGS. 4A and 7, and toward second tilt pulley 96. Tilt line guide arms 107 prevent entanglement of tilt pulley line 98 with inner carriage 30. The line segment then loops around second tilt pulley 96, and back up to a lower end 28*a* of tilt strip 28 and is attached thereto via an associated line clip. The other line segment wound around and extending from first tilt pulley 94 extends downwardly to an upper end 28*h* of tilt strip 28 and is attached thereto via an associated line clip, thereby forming a closed tilt loop L, as shown in FIG. 5. In this way, linear, axial, bi-directional motion of closed loop L is converted into corresponding rotary, bi-directional motion.

Figure 11:
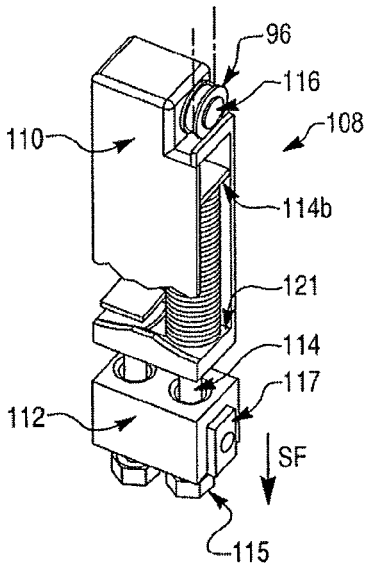
FIG. 11 is a fragmentary perspective view of the tension pulley assembly of FIG. 10.
Figure 10:
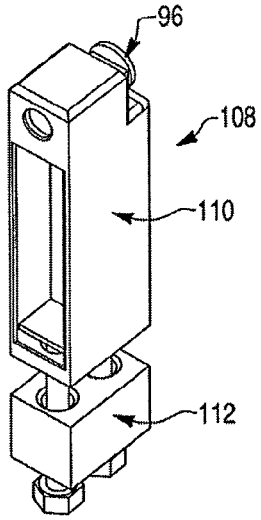
FIG. 10 is a perspective view of a lower tension pulley assembly.
Figure 12:
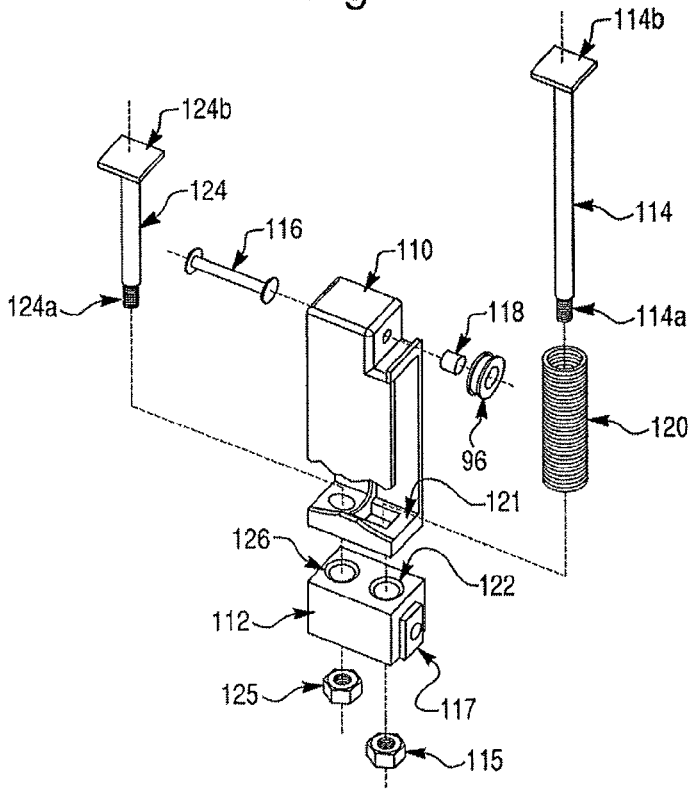
FIG. 12 is a fragmentary exploded view of the lower tension pulley assembly of FIG. 10.
Figure 13:
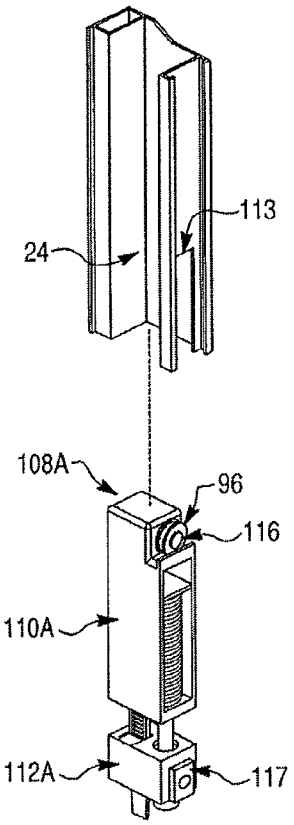
FIG. 13 is a perspective view of a lower tension pulley assembly according to another embodiment, showing a fragmentary view of the inner carriage housing.
Figure 14:
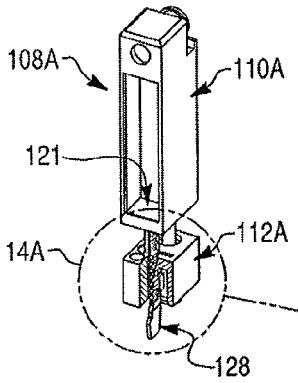
FIG. 14 is a fragmentary perspective view of the lower tension pulley assembly of FIG. 13.
Figure 14A:
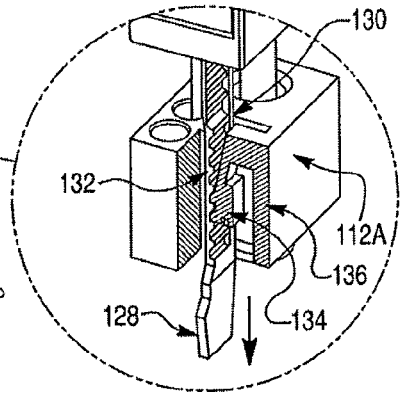
FIG. 14A is a detail view of circled portion 14A in FIG. 14.

Preferably, second tilt pulley 96 is secured to a lower tension pulley assembly 108, as best shown in FIGS. 3, 3B and 10-12. Lower tension pulley assembly 108 accommodates the looping of the lower regions of tilt pulley lines 98 and facilitates tensioning, guiding and displacement of tilt pulley lines 98 as required to generate the tilt function. Lower pulley assembly 108 includes a tension pulley housing 110 connected to and moveably spaced from a retaining block 112 via a first tension bolt 114. Tension pulley housing 110 is slidably disposed within carriage housing 24. Retaining block 112 may be secured within carriage housing 24 via a lower retaining notch 113 formed in the lower end of carriage housing 24, which cooperates with a locating boss 117 disposed on retaining block 112, as best shown in FIGS. 11, 12 and 13. Second tilt pulley 96 is rotatably secured to tension pulley housing 110 via a tension pulley shaft 116. A bushing 118 may be retained on tension pulley shaft 116 and receivable in an associated bore extending through second tilt pulley 96, which ensures proper rotation of second tilt pulley 96.

A compression spring 120 may be retained on first tension bolt 114 between a threaded end 114*a* and head 114*b*, with a downwardly directed spring force shown by arrow SF. Spring 120 exerts a downward force on a bottom surface 121 of tension pulley housing 110. Retaining block 112 includes a first opening 122 through which first tension bolt 114 is received. First tension bolt 114 extends through a corresponding opening in bottom surface 121 of tension pulley housing 110, and through first opening 122, which preferably extends entirely through retaining block 112. Threaded end 114*a* of tension bolt extends through first opening 122 and is secured to retained block 112 via an associated lock nut 115. Tension pulley housing 110 is biased toward retaining block 112 via spring 120. Because the length of first tension bolt 114 and tension of spring 120 may be selected, a predetermined level of tension on closed loop L may be maintained. When the predetermined level of tension is applied to tilt pulley lines 98, gripping and moving, tilt strip 28 in first or second directions D1, D2 causes slats 20 to tilt correspondingly, as desired. However, this configuration does not expose tilt pulley line 98 to sliding friction (see FIGS. 4, 5 and 16).

Lower tension pulley assembly 108 may include a second tension bolt 124 disposed between and connecting tension pulley housing 110 and retaining, block 112. Retaining block 112 may include a second opening 126 extending therethrough, and adjacent and parallel to first opening 122. Second tension bolt 124 extends through a corresponding opening in bottom surface 121 of tension pulley housing 110, and through second opening 126. A threaded end 124*a* of second tension bolt 124 extends through second opening 126 and is secured to retaining block 112 via an associated lock nut 125. Second tension bolt 124 defines a maximum axial displacement between tension pulley housing 110 and retaining block 112, given the head 124*b* of second tension bolt 124 is larger than the corresponding opening, in bottom surface 121 of tension pulley housing 110.

First tension bolt 114 and compression spring 120 control the operating tension in closed loop L, while second tension bolt 124 controls the maximum level of slack during the tilt adjustment process by limiting the axial distance tension pulley housing 110 can move upward within carriage housing 24 and allow slack in closed loop L. An optimal setting is achieved by balancing these adjustments. As tilt pulley lines 98 are tensioned, an upward force is exerted on second tilt pulley 96 and therefore on tension pulley housing 110. As tension pulley housing 110 is displaced upwardly, it exerts a force on compression spring 120, which contacts surface 121. Because spring 120 is retained between bottom surface 121 and head 114*a* of first tension bolt 114, spring 120 begins to compress. The greater the displacement of tension pulley housing 110, the greater the opposing spring force. In this way, sufficient tension in closed loop L (see FIG. 5) is maintained.

With closed loop L tensioned via lower tension pulley assembly 108, it is obvious to those of skill in the art that axially displacing tilt strip 28 will cause first tilt pulley 94 to rotate forward or backward in concert with this displacement. Since tilt spools 76 are mechanically coupled to first tilt pulley 94 via tilt drive spool 78, drive bar 86 and tilt rod 74, any rotation of first tilt pulley 94 will result in a corresponding tilting of slats 20.

Figure 15:
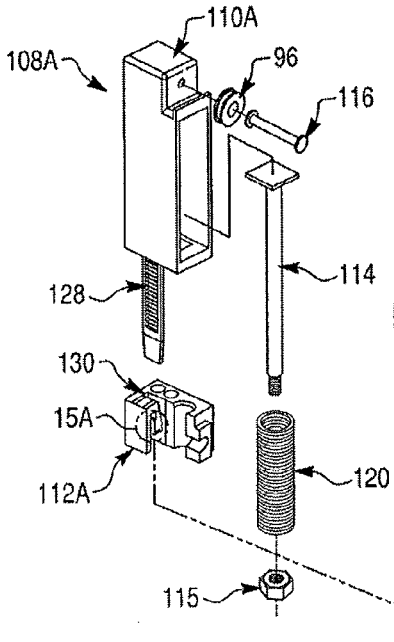
FIG. 15 is an exploded partially fragmentary view of the lower tension pulley assembly of FIG. 13.
Figure 15A:
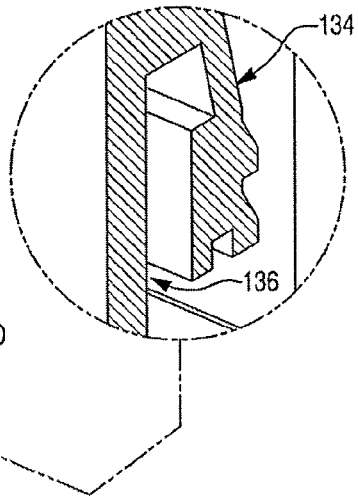
FIG. 15A is a detail view of circled portion 15A in FIG. 15.

Another embodiment of a lower tension pulley assembly 108A is best shown in FIGS. 13-15A. As shown, similar to lower tension pulley assembly 108, lower tension pulley assembly 108A includes tension spring 120 and associated components. However, lower tension pulley assembly 108A includes a tension pulley housing 110A having a ratchet arm 128 extending outwardly from bottom surface 121. A retaining block 112A is provided having a slot 130 configured for receiving ratchet arm 128. Ratchet arm 128 includes teeth 132 engageable and cooperating with a locking lever 134 extending outwardly from an inner wall 136 of slot 130, as best shown in FIG. 15A. Ratchet arm 128 is received in slot 130. Locking lever 134 permits downward movement of teeth 132 on ratchet arm 128, and thus downward movement of tension pulley housing 110A toward retaining block 112A. However, locking lever 134 restricts upward movement of teeth 132 on ratchet arm 128. A predetermined level of tension on closed loop L may be maintained, given ratchet arm 128, locking lever 134 and spring 120 continuously adjust assembly 108A, thereby providing maximum axial spacing between tension pulleys 94 and 96. In this way, excess slack in tilt pulley lines 98 that may develop over a period of time, due to extended usage, will be eliminated. The particular manner in which the ratchet arm 128 and locking lever 134 cooperate and engage to produce the aforementioned locking of the components in one direction of movement is well known to those of skill in the art.

Referring to FIGS. 4, 6, 7, 16 and 16A, tilt strip 28 is coupled to lower portion 36 of inner carriage 30. A grip magnet bracket 138 may be secured to lower portion 36, and first grip magnets 140 fixedly secured thereto. Second grip magnets 142 are provided, which are magnetically coupled to first grip magnets 140. Tilt strip 28 is disposed and secured between first and second grip magnets 140, 142, as best shown in FIGS. 16 and 16A. Magnetic coupling between first and second grip magnets 140, 142 is sufficiently strong such that tilt strip 28 is moveable in first and second directions D1, D2 when inner carriage 30 is moved.

The range of linear movement in first and second directions D1, D2 of tilt strip 28 that is required to actuate tilting of slats 20 is relatively small compared to the range of movement of inner carriage 30 that is required to actuate lifting or lowering slats 20. As such, first and second grip magnets 140, 142 act as a clutch, permitting tilt strip 28 to de-couple from, and slide between, first and second grip magnets 140, 142 when a force is applied to inner carriage 30 in one of first and second directions D1 or D2, that exceeds a friction threshold resulting from grip magnets 140 and 142 which also act to oppose the axial movement of inner carriage 30. In order to facilitate de-coupling, and subsequent re-coupling of first and second grip magnets 140 and 142 when the threshold force is no longer being applied, second grip magnets 142 may be retained in a floating grip magnet housing 144, as best shown in FIG. 7. Floating grip magnet housing 144 permits a sufficient amount of movement of second grip magnets 142 to facilitate misalignment and a resultant magnetic de-coupling from first grip magnets 140. However, first and second grip magnets 140, 142 are sufficiently close to each other, and have a sufficiently strong magnetic attraction, to ensure re-coupling when the threshold force is no longer exceeded, thereby re-engaging and securing tilt strip 28 therebetween.

As shown in FIGS. 7, 16 and 16A, a pair of first grip magnets 140 are magnetically coupled with a pair of corresponding second grip magnets 142, and exert a clamping force on tilt strip 28. Second grip magnets 142 are housed in pockets machined or formed into floating grip magnet housing 144 that allows them to 'float' in the clamping direction only (i.e. substantially perpendicular to first and second directions D1, D2). When grip magnet housing 144 is moved up or down in first or second direction D1, D2, second grip magnets 142 follow. As second grip magnets 142 begin to move, tilt strip 28 is carried along due to the clamping force exerted by first and second grip magnets 140, 142, thereby causing tilt lines 22 and consequently slats 20 to tilt in the direction of the torque applied to tilt rod 74 via tilt loop L. At a certain point of rotation, slats 20 have fully rotated (either upwardly or downwardly) and can no longer move due to rotation limiting stem 90 and contact face 92. This in turn causes tilt strip 28 to stop moving given it is mechanically coupled to slats 20 via tilt drive spool 78. However, inner carriage 30 and therefore first and second grip magnets 140, 142 may continue to be moved. As first and second grip magnets 140, 142 continue moving, they begin to slide along tilt strip 28. Reversing direction of movement from D1 to D2 or vice versa) of first and second grip magnets 140, 142 causes tilt strip 28 to move in the opposite direction, thereby causing slats 20 to rotate in the opposite direction until their limit of rotation is reached. At that point, first and second grip magnets 140, 142 slide along tilt strip 28 as inner carriage 30 continues its linear motion within carriage housing 24.

Floating grip magnet housing 144 is preferably disposed in pocket 36*a* of inner carriage 30 proximate to grip magnet bracket 138, which is also housed in pocket 36*a*, so that it can slide axially in the direction of movement of inner carriage 30 without being rigidly affixed to inner carriage 30 or another body. In this way, after slats 20 have completed their rotation, tilt strip 28 is temporarily disposed in a 'fixed' position in relation to magnets 140 and 142. Because first grip magnets 140 are securedly fixed to grip magnet bracket 138, and second grip magnets 142, housed in floating magnet housing 144, are free to slide axially in pocket 36*a*, first and second grip magnets 140, 142 will become misaligned on opposing faces of tilt strip 28. This misalignment may vary due to variations in mounting, friction, inertia, mating surface texture, velocity of actuation, and other factors that affect the relative position of these magnets to each other on each of the opposing sides of tilt strip 28, when inner carriage 30 is in motion. This misalignment resulting from motion is advantageous because the greater the misalignment, the less the magnetic clamping force, and therefore the less drag on inner carriage 30 as it moves within carriage housing 24.

Because first and second grip magnets 140, 142 are constantly engaging tilt strip 28, the surface of tilt strip should be sufficiently smooth to allow for a relatively unobstructed movement of inner carriage 30. However, there must be sufficient friction between tilt strip 28 and first and second grip magnets 140, 142 to ensure that slats 20 may be fully tilted in either direction before first and second grip magnets 140, 142 de-couple and slide along tilt strip 28. Too much friction allows for slats 20 to be tilted effectively, but increases undesired external friction and drag on the free movement of inner carriage 30.

The configuration of floating grip magnet housing 144 ensures a balance between unobstructed movement and sufficient friction. When inner carriage 30 is in motion and a threshold force acting on first and second grip magnets 140, 142 has been exceeded (i.e. slats 20 have been fully tilted), first and second grip magnets 140, 142 become misaligned given second grip magnets 142 are free to move axially and displace out of magnetic alignment. As inner carriage 30 moves, second grip magnets 142, which are pressing against tilt strip 28, encounter axial frictional forces resulting from the relative movement of tilt strip 28. This friction or 'drag' causes second grip magnets 142 to be pulled back in an effort to affix to the surface of tilt strip 28, and consequently misalign in relation to first grip magnets 140. Any misalignment of first grip magnets 140 to second grip magnets 142 reduces the magnetic coupling forces, which in turn reduces drag on the movement of inner carriage 30. Once movement of inner carriage 30 is stopped, first and second grip magnets 140, 142 automatically re-align due to mutual attraction.

This effect can be optimized by balancing the roughness or texture of a particular surface or surfaces of tilt strip 28. The desired result is a good grip of tilt strip 28 by first and second grip magnets 140, 142 when tilting slats 20, when there is minimal movement of inner carriage 30. Conversely, minimal gripping force is desirable when raising or lowering slats 20, when there is rapid or extended movement of inner carriage 30. Tilt lines 22, which are coupled to slats 20, are exposed to minimal stress. Any frictional forces and associated line tensions are isolated and redirected to tilt strip 28, tilt pulley line 98, and tilt drive spool 78, which are substantially more robust than tilt lines 22.

In addition, tilt strip 28 may be formed from a material which is ideally suited to sustain wear over long periods of use, such as ultra-high molecular weight (UHMW) polyethylene. Unlike conventional units that expose ladder lines to direct friction and premature failure, the disclosed assembly improves tilt function with repeated use. Repeated use causes tilt strip 28 to wear slightly and become thinner. This reduces the distance between first and second grip magnets 140, 142, thereby increasing the gripping force on tilt strip 28. As such, grip function is improved over time and repeated usage.

An alternative embodiment of a raise/lower and tilt mechanism is shown in FIGS. 17-20. An inner carriage 200 is provided, which includes some of the same features as inner carriage 30, and are referenced accordingly. Inner carriage 200 includes a first inner carriage, or upper portion 202, which is slidably connected to a second inner carriage, or lower portion 204. Upper portion 202 includes a first magnet chamber 206 in which first inner carriage magnet 40 is disposed. A cover plate 207 may be provided, against which first inner carriage magnet 40 is secured. Lower portion 204 includes a second magnet chamber 208 in which a second inner carriage magnet 210 is disposed. A cover plate 207 may also be provided against which second inner carriage magnet 210 is secured.

Figure 17:
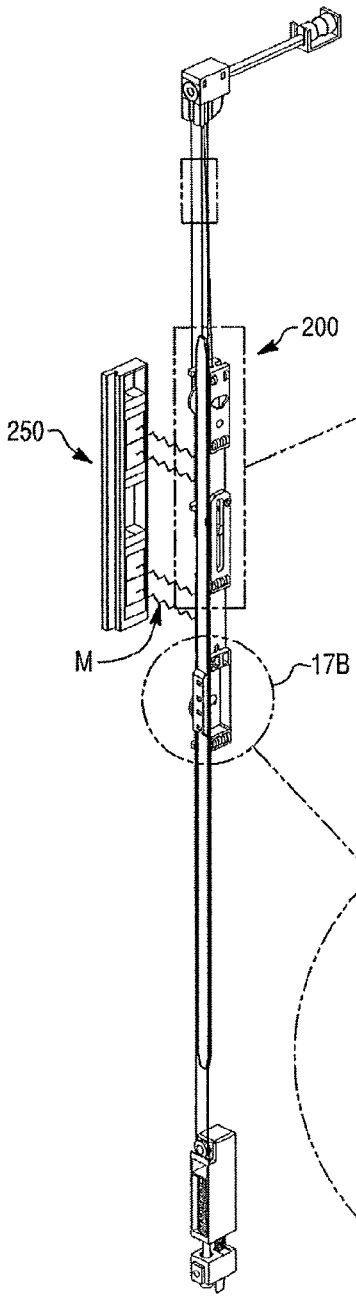
FIG. 17 is a perspective view of components of a raise/lower and tilt mechanism according to an embodiment of present invention.
Figure 17A:
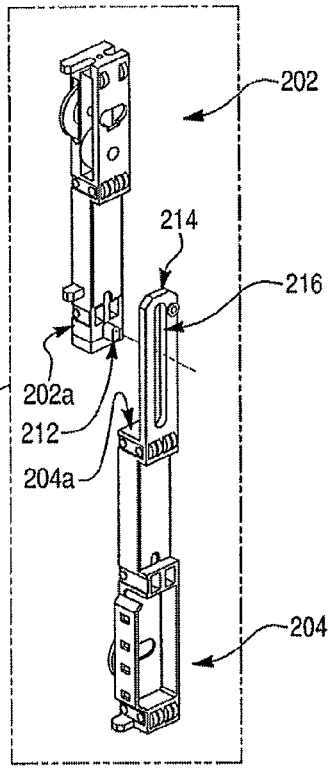
FIG. 17A is a perspective view of components of an inner carriage assembly shown in FIG. 17.
Figure 19:
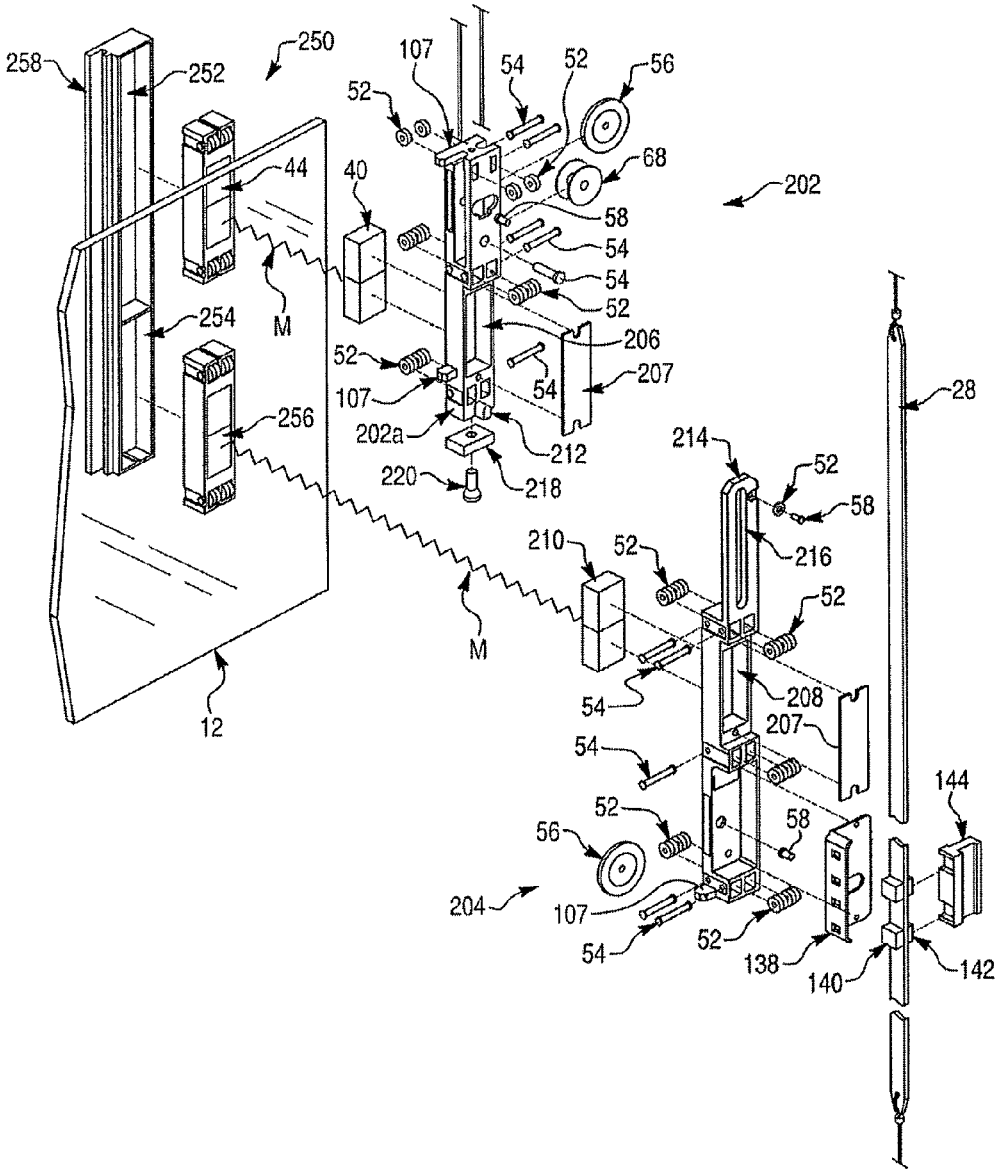
FIG. 19 is a fragmentary partially exploded view of components shown in FIG. 17.
Figure 20:
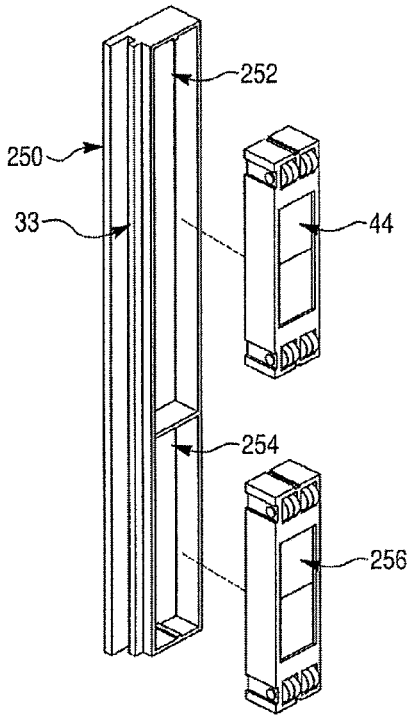
FIG. 20 is a perspective partially exploded view of an external slide knob shown in FIG. 17.

Upper portion 202 preferably includes a hitch post 212 extending outwardly from a lower end 202*a* thereof, as best shown in FIGS. 17A and 19. Lower portion 204 includes a hitch arm 214 extending axially from an upper end 204*a* thereof, with a hitch slot 216 disposed therein. Hitch post 212 is slidably received in hitch slot 216 so that first inner carriage magnet 40 of upper portion 202 is moveably spaced from second inner carriage magnet 210 of lower portion 204. A bumper pad 218 may be secured to lower end 202*a* via an associated retaining screw 220. Bumper pad 218 absorbs any impact that may be sustained between upper portion 202 and lower portion 204 when hitch post 212 is disposed in the lowermost, end of hitch slot 216 and upper and lower portions 202, 204 converge and make contact.

Figure 18:
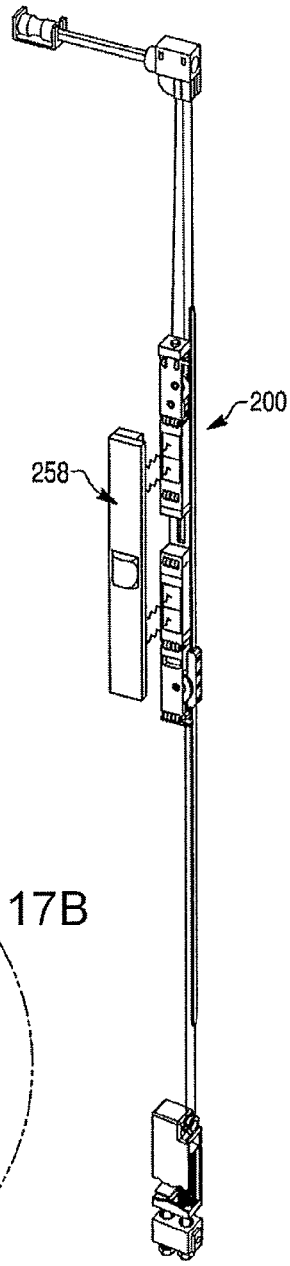
FIG. 18 is a perspective view of components of the raise/lower and tilt mechanism of FIG. 17 viewed from another orientation.
Figure 17B:
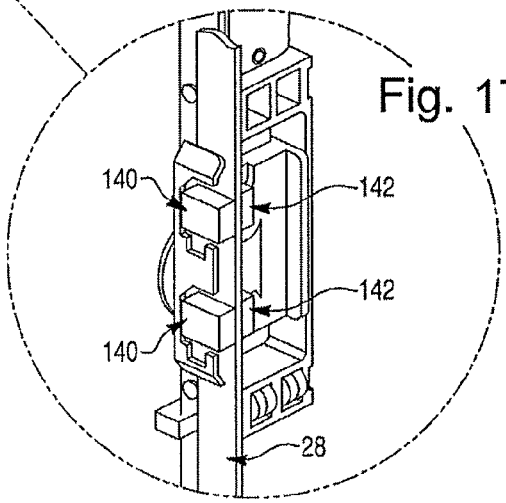
FIG. 17B is a detail view of circled portion 17B in FIG. 17, with portions shown in phantom.

An external slide knob assembly 250 is provided which cooperates with inner carriage assembly 200. External slide knob assembly 250 includes slide knob housing 258 which incorporates upper chamber 252 configured for housing first external carriage magnet 44, which is magnetically coupled to first inner carriage magnet 40. External slide knob assembly 250 also includes a lower chamber 254 configured for housing a second external carriage magnet 256, which is magnetically coupled to second inner carriage magnet 210. External slide knob assembly 250 preferably includes an exteriorly disposed slide knob housing 258, which is gripped by the user during operation, as best shown in FIG. 18. First external carriage magnet 44 and second external carriage magnet 256 may be identical in configuration, as shown in FIG. 19.

Lower chamber 254 is preferably configured and sized to tightly fit second external carriage magnet 236, so that second external carriage magnet 256 is in a fixed position therein. However, upper chamber 252 is preferably configured and sized so that first external carriage magnet 44 is slidably disposed therein in first and second directions D1, D2. In this way, second external carriage magnet 256 may be moved a predetermined distance in either first or second directions D1, D2 while maintaining first external carriage magnet 44 in a fixed position.

The adjustably spaced connection of upper portion 202 to lower portion 204, as well as the permissible movement of first external carriage magnet 44 within upper chamber 252, allows the tilt of slats 20 to be adjusted by moving lower portion 204 without moving upper portion 202. As such, tilting may be adjusted without causing slats 20 to raise or lower. In the first embodiment, when adjusting the tilt of the slats 20, slats 20 are also raised or lowered slightly given upper portion 34 of carriage moves whenever lower portion 36 is moved. Inner carriage 200 allows for sufficient movement of lower portion 204 (thereby adjusting tilt) without moving upper portion 202.

Figure 21:
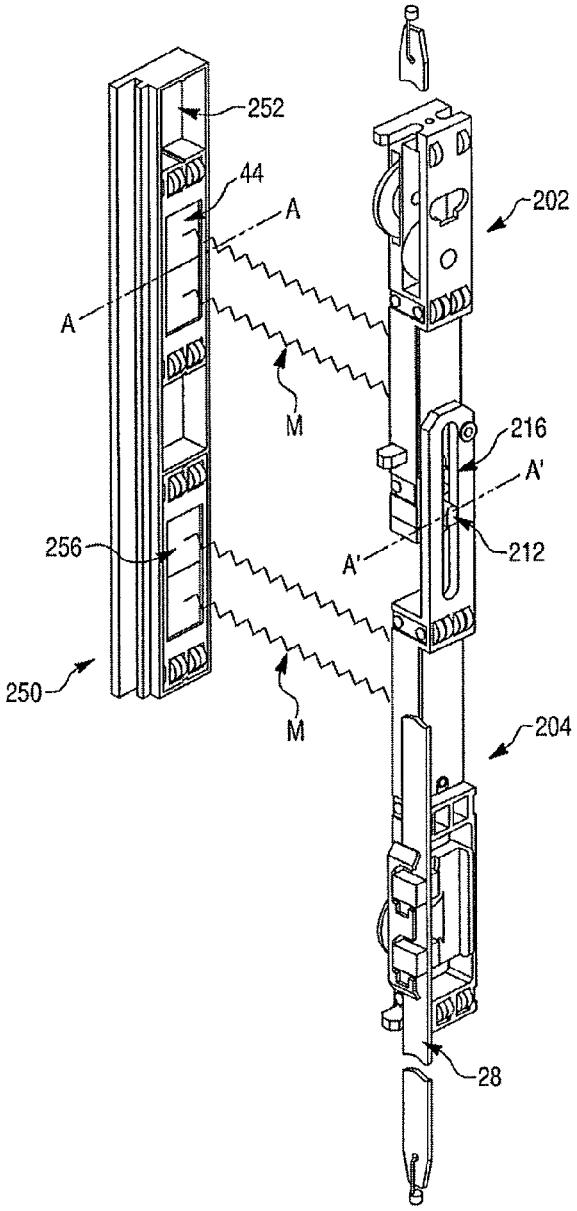
FIG. 21 is a perspective fragmentary view of inner and external carriages of FIG. 17 in a first orientation.
Figure 22:
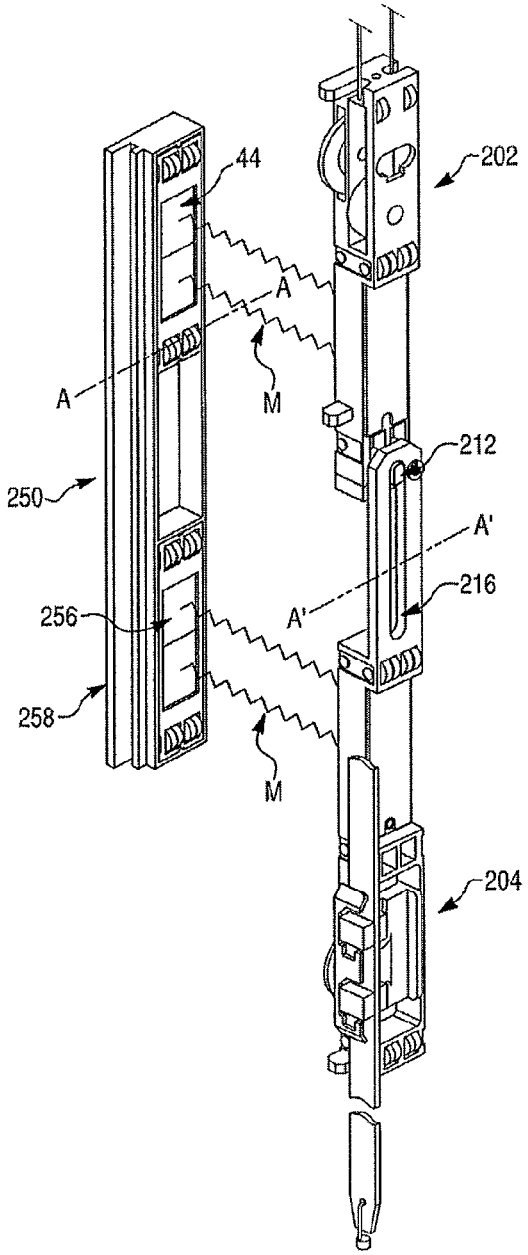
FIG. 22 is a perspective fragmentary view of inner and external carriages of FIG. 17 in another orientation.

As shown in FIG. 21, first external carriage magnet 44 is disposed at a central position A-A within upper chamber 252 and aligned with first inner carriage magnet 40, so that hitch post 212 is disposed at a center position A'-A' in hitch slot 216. Second external carriage magnet 256 is aligned with second inner carriage magnet 210. When slide knob 258 is moved downwardly, second external carriage magnet 256 pulls lower portion 204 downwardly via magnetic coupling with second inner carriage magnet 210, as shown in FIG. 22. Although motionless, hitch post 212, in relative terms, slides to an upper position within hitch slot 216 until it contacts the upper end of hitch slot 216. In addition, first external carriage magnet 44, which remains motionless, slides upwardly within and relative to, upper chamber 252 which displaces downward. Magnetic coupling between first inner carriage magnet 40 and first external carriage magnet 44 is maintained without movement of upper portion 202.

Figure 23:
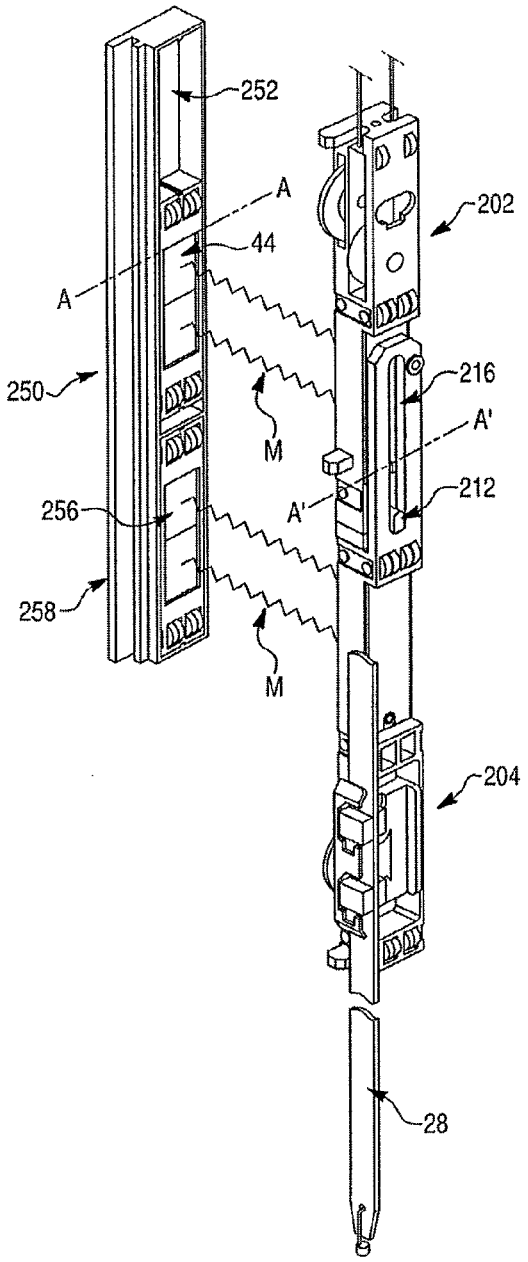
FIG. 23 is a perspective fragmentary view of inner and external carriages of FIG. 17 in another orientation.
Figure 24:
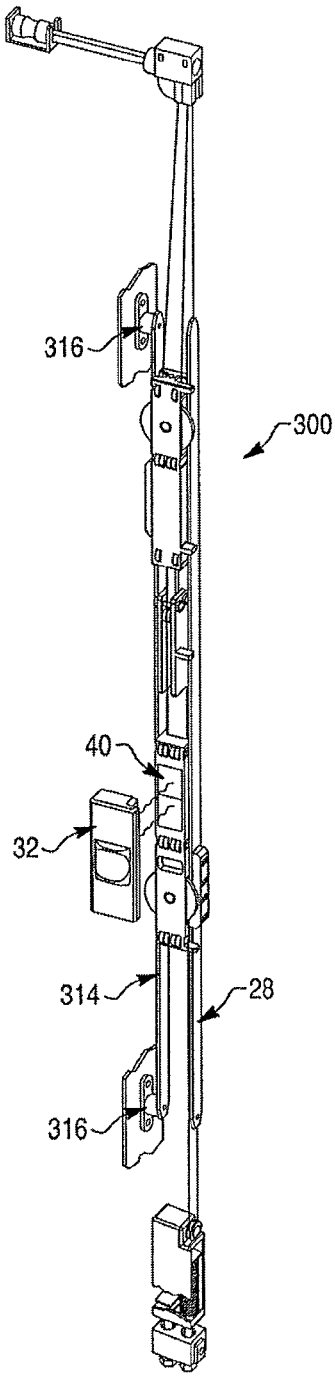
FIG. 24 is a perspective view of components of a raise/lower and tilt mechanism according to another embodiment, with a fragmentary view of the carriage housing.
Figure 25:
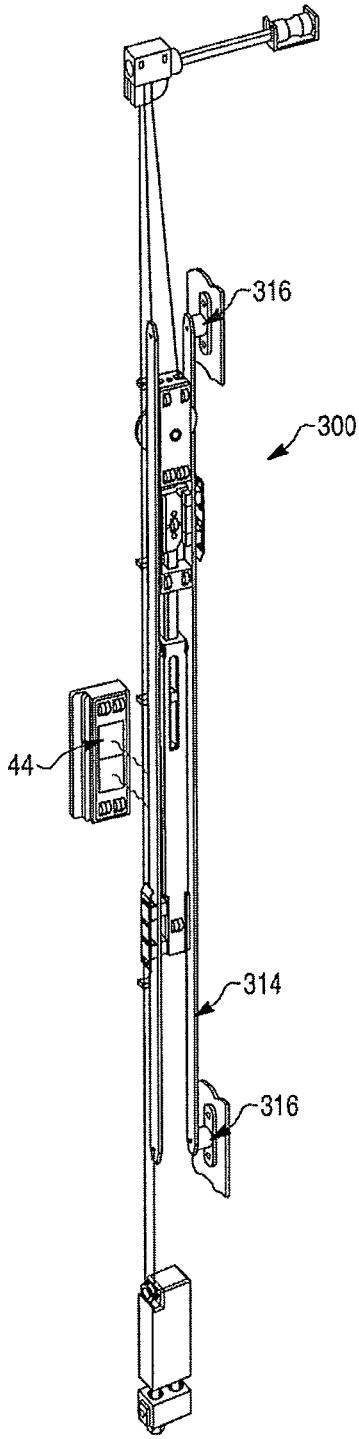
FIG. 25 is another perspective view of components the mechanism of FIG. 24 viewed from another orientation.

When slide knob 258 is moved upwardly, second external carriage magnet 256 pulls lower portion 204 upwardly via magnetic coupling with second inner carriage magnet 210, as shown in FIG. 23. In relative terms, hitch post 212 slides to a lower position within hitch slot 216. In addition, first external carriage magnet 44 slides downwardly within upper chamber 252. Magnetic coupling between first inner carriage magnet 40 and first external carriage magnet 44 is maintained without movement of upper portion 202.

In this way, tilting of slats 20 may be adjusted without actuating raising or lowering of window blind 18. Continued linear motion of external carriage 250 along guide track 38, and thus both portions of inner carriage 200 within carriage housing 24, in either direction, D1 or D2, actuates the raising or lower function as described above.

Another embodiment of a raise/lower and tilt mechanism is best shown in FIGS. 24-28. An inner carriage 300 is provided, which includes some of the same features as inner carriages 30 and 200, and are referenced accordingly. Inner carriage 300 includes a first inner carriage, or upper portion 302, which is slidably connected to a second inner carriage, or lower portion 304. An arm 306 is slidably coupled to upper portion 302, and extends axially therefrom, with a hitch post 308 extending outwardly from a distal end.

Lower portion 304 is slidably coupled to a slotted coupling housing 309 via lower end **309*a* of slotted coupling housing 309 and floating grip magnet housing 144*a* which is slidably received in pocket 304*a*. Pocket 304*a* also receives bracket 138. Retaining rollers 322 may be provided proximate an upper end of slotted coupling housing 309, which ensure that arm 306 and integrated hitch post 308 remain slidably aligned within coupling housing 309 when under tension. Guide rollers 52 may also be provided at opposite ends of slotted coupling housing 309, which align slotted coupling housing 309 within inner carriage housing 24. Hitch post 308 is slidably received in hitch slot 310. Lower portion 304 includes a magnet chamber 312 in which first inner carriage magnet 40 is disposed, and grip magnets 140, 142 operably associated with tilt strip 28 as described above. However, second grip magnets 142 are disposed in a floating grip magnet housing 144A that includes a channel and cavities to accommodate attachment of a lower end 309*a* of slotted coupling housing 309**.

Upper portion 302 includes a second set of grip magnets 140, 142, which are retained within a grip magnet bracket 138A and a floating grip magnet housing 144B, respectively. However, a retaining strip 314 is disposed between grip magnets 140, 142 associated with upper portion 302. Floating grip magnet housing 144B is similar to floating grip magnet housing 144. However, floating grip magnet housing 144 includes a solid profile and is not mechanically attached to other components. In contrast, floating grip magnet housing 144B may include holes, channels and/or cavities to accommodate attachment of arm 306 thereto, as well as one or More guide rollers 52 to minimize friction between inner carriage 300 and carriage housing 24.

Opposite ends of retaining strip 314 are secured to carriage housing 24 via retaining brackets 316 and associated bolts 318. Alternatively, retaining strip 314 may be rigidly affixed to some other frame element. Preferably, retaining strip 314 is substantially parallel to tilt strip 28. Retaining strip 314 may be identical to tilt strip 28 in length and cross-section, and may be formed for a similar material. Upper portion 302 is maintained at a predetermined position along retaining strip 314 via its associated grip magnets 140, 142. However, grip magnets 140, 142 of upper portion 302 de-couple and slide along retaining strip 314 if a predetermined threshold force in one of first and second directions D1, D2 is exceeded during movement of inner carriage 300.

Figure 26:
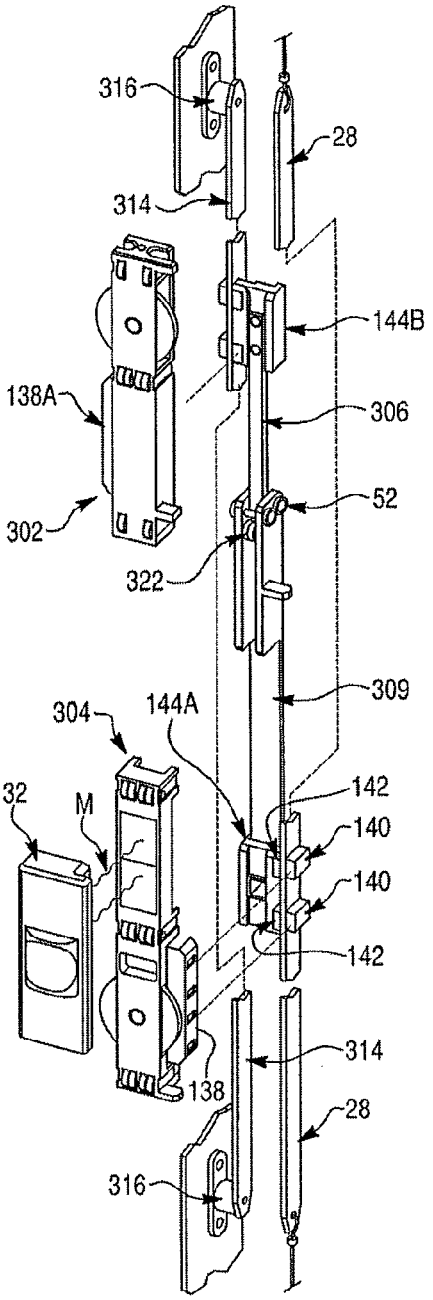
FIG. 26 is a fragmentary, partially exploded view of inner and external carriages of FIG. 24.
Figure 27:
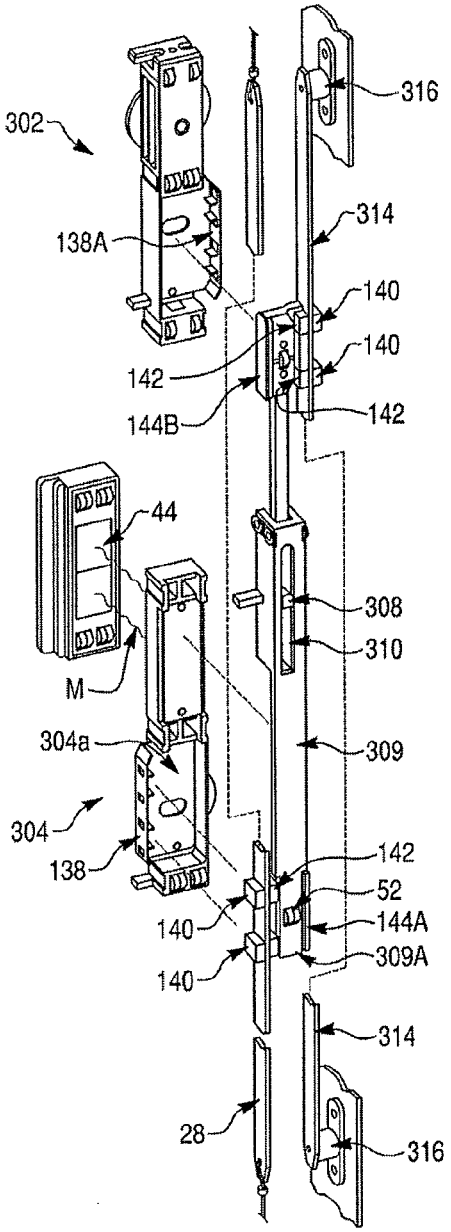
FIG. 27 is a fragmentary, partially exploded view of components of FIG. 26 viewed from another orientation.
Figure 28:
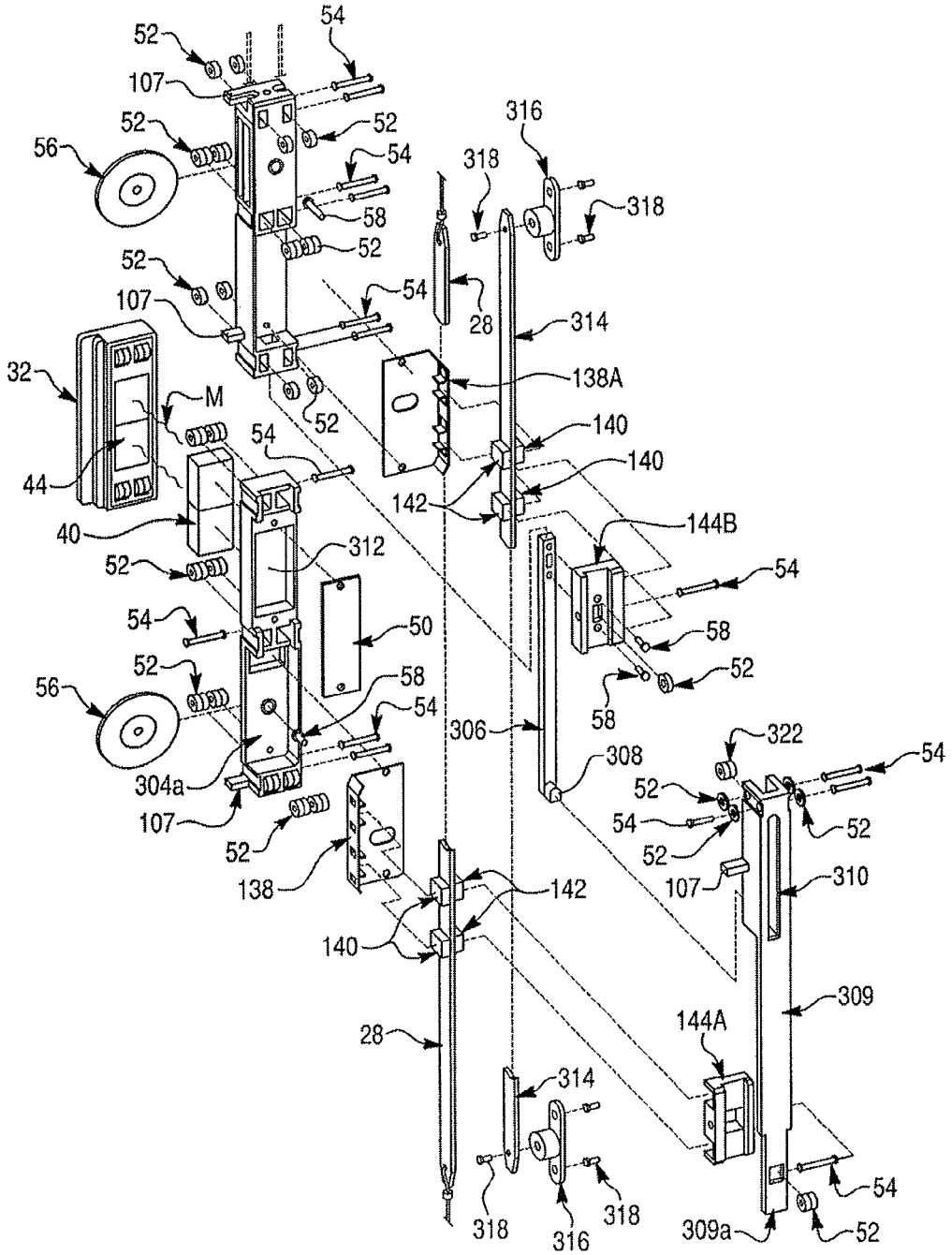
FIG. 28 is a fragmentary, partially exploded view of components of FIG. 24.

Lower portion 304 is magnetically coupled to first external carriage magnet 44 in external carriage 32, as shown by lines M in FIGS. 26 and 27. Upper portion 302 is not magnetically coupled to external carriage 32. However, upper portion 302 is moved within carriage housing 24 as lower portion 304 is moved, if a predetermined threshold of force and displacement is exceeded, given upper and lower portions 302, 304 are mechanically connected via hitch post 308 and hitch slot 310. As described above, lower portion 304 is coupled to tilt pulley lines 98 for actuating the tilt function of slats 20.

Figure 29:
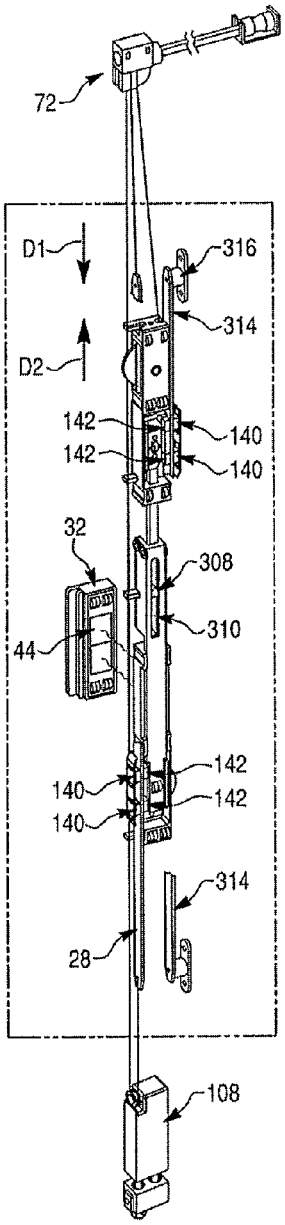
FIG. 29 is a fragmentary perspective view of components of the control mechanism of FIG. 24 in a first orientation.
Figure 29A:
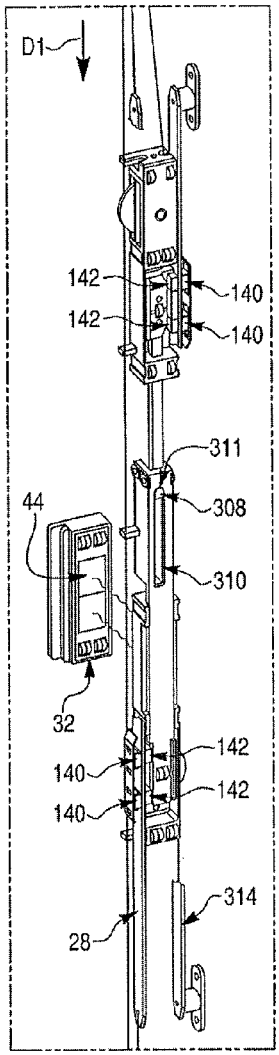
FIG. 29A is a fragmentary perspective view of components of the control mechanism of FIG. 24 in another orientation.

As shown in FIG. 29, hitch post 308 is disposed within hitch slot 310 in a central orientation. As shown in FIG. 29A, when external carriage 32 is moved downwardly in first direction D1, lower portion 304 is also moved in direction D1 due to magnetic coupling between first external carriage magnet 44 and first inner carriage magnet 40. Tilt strip 28 is moved, in first direction D1 due to clamping forces of first and second gripping magnets 140, 142 against tilt strip 28, which are aligned and magnetically coupled. Slats 20 are thereby tilted to a fully upward position.

Upper portion 302 is maintained in a fixed position due to the clamping forces of first and second gripping magnets 140, 142 against retaining strip 314. As such, no raise/lower function is actuated. In addition, during the relatively short displacement of slide knob 32, there is no direct application of force to upper portion 302. Without movement of upper portion 302, there is no corresponding raise or lower movement, of slats 20. However, relative to hitch slot 310, hitch post 308 slides to an upper position within hitch slot 310. Accordingly, hitch slot 310 should be sufficiently long such that movement of hitch post 308 within hitch slot 310 tilts slats 20 fully upward when hitch post 308 is disposed at an upper most position within hitch slot 310, as shown in FIG. 29C, slats 20 are tilted fully downward when hitch post 308 is disposed at a lowermost position within hitch slot 310.

Figure 29B:
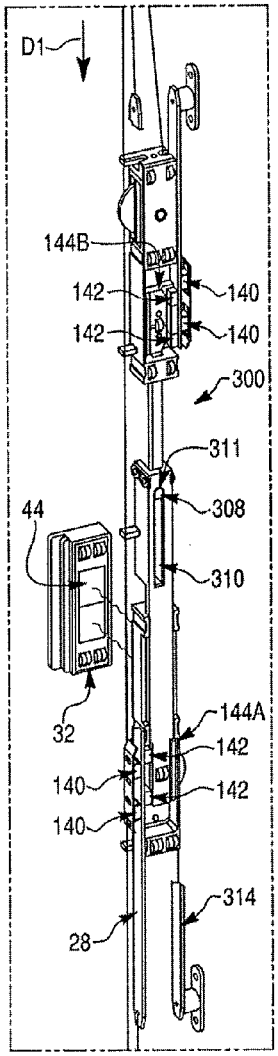
FIG. 29B is a fragmentary perspective view of components of the control mechanism of FIG. 24 in another orientation.

Downward displacement of tilt strip 28 actuates the corresponding rotation of slats 20 via tilt strip 28. Once slats 20 are fully rotated, hitch post 308 is in contact with an upper contact face 311, as shown in FIG. 29B. At this time, continued movement downward in first direction D1 causes lower portion 304 to pull upper portion 302 in first direction D1. This pulling force causes grip magnets 140, 142 of upper portion 302 to become misaligned and de-couple from retaining strip 314, as shown in FIG. 29B. Likewise, first and second grip magnets 140, 142 of lower portion 304, which continues to displace downward in direction D1, misalign and de-couple from tilt strip 28. Grip magnets 142, of lower portion 304, are temporarily retained by upper portion 302 in opposition to the movement of lower portion 304 which is moving in direction D1. This temporary retention of grip magnets 142 allows them to misalign from corresponding grip magnets 140 which are moving oppositely with lower portion 304. In addition, the weight of slats 20 provides a force opposing downward movement of upper and lower portions 302 and 304. Because of the opposing forces, the weight of slats 20 bears upon grip magnets 140, 142, thereby assisting in the de-coupling. Slats 20 are raised as upper portion 302 proceeds downwardly in first direction D1. Once movement of external carriage 32 is terminated, movement of inner carriage 300 terminates. Grip magnets 140, 142 of upper and lower portions 302, 304 automatically realign due to their close magnetic proximity, thereby re-clamping retaining strip 314 and tilt strip 28. The tilt of slats 20 may then be adjusted if desired.

Figure 29C:
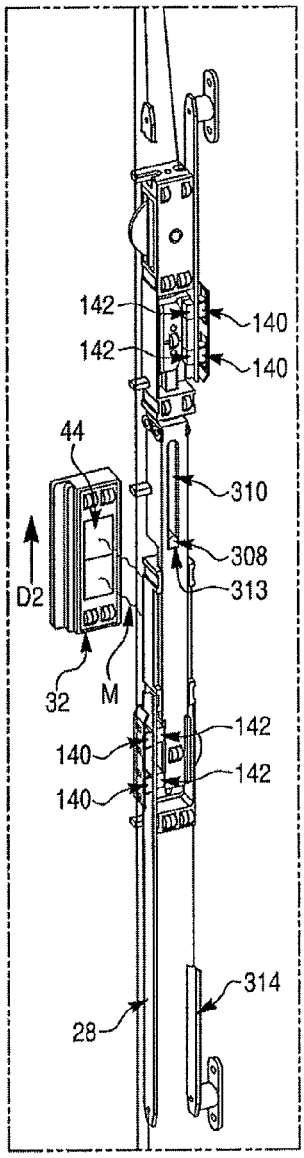
FIG. 29C is a fragmentary perspective view of components of the control mechanism of FIG. 24 in another orientation.
Figure 29D:
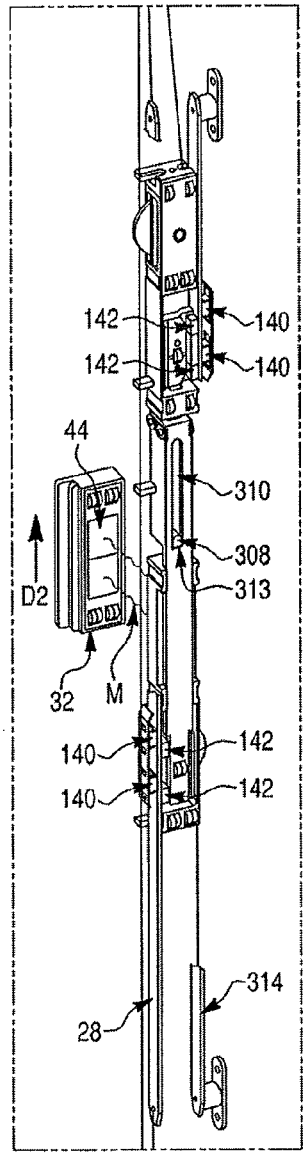
FIG. 29D is a fragmentary perspective view of components of the control mechanism of FIG. 24 in another orientation.

As shown in FIG. 29C, when external carriage 32 is moved upwardly in second direction D2, lower portion 304 is also moved in direction D2 due to magnetic coupling therebetween. Tilt strip 28 is moved in second direction D2 due to clamping forces of first and second gripping magnets 140, 142 against tilt strip 28, which are aligned and magnetically coupled. Slats 20 are thereby tilted to a fully downward position.

Upper portion 302 is maintained in a fixed position due to the clamping forces of first and second gripping magnets 140, 142 against retaining strip 314. As such, no raise/lower function is actuated. In addition, during the relatively short displacement of slide knob 48, there is no direct application of force to upper portion 302. Without movement of upper portion 302, there is no corresponding raise or lower movement of slats 20. However, hitch post 308 slides to a lower position within hitch slot 310.

Upward displacement of tilt strip 28 actuates the corresponding rotation of slats 20 via tilt strip 28. Once slats 20 are fully rotated, hitch post 308 is in contact with a lower contact face 313, of hitch slot 310, as shown in FIG. 29C. At this time, continued movement upward in second direction D2 of lower portion 304 causes the attached tilt grip magnets 140 to also displace upwardly. First grip magnets 142 are temporarily restricted from moving upward with lower portion 304, due to friction associated with upper grip magnets 140 and 142 gripping the retaining strip 314, in upper portion 302. This frictional force, in opposition to the movement of lower portion 304, is transferred to tilt grip magnets 142 via slotted housing face 313 contacting hitch post 308. Since the upward force of lower portion 304 exceeds the coupling and friction force of tilt grip magnets 140 and 142, which are temporarily retained by upper portion 302 as noted above, misalignment and de-coupling of tilt grip magnets 140 and 142 occurs. With the de-coupling of the tilt grip magnets 140 and 142, the grip and associated friction on tilt strip 28 is reduced or removed, allowing lower portion 304 to move freely within inner carriage housing.

As lower portion 304 continues upward in direction D2, an upward force is exerted on retaining strip grip magnets 142 which are coupled to retaining strip grip magnets 140, in upper portion 302. Since the upward force exerted on retaining strip grip magnets 142 exceeds the opposing frictional force associated with gripping retaining strip 314, grip magnets 142 de-couple from grip magnets 140 to a particular degree that allows the weight of the slats to pull upper portion 302, now partially unsecured to retaining strip 314, downward. Thus, a portion of friction opposing the free movement of upper portion 302 in housing 24 is eliminated due to the misalignment of retaining strip grip magnets 140 and 142. Additionally the weight of the slats 20 pulling upward on portion 302 also contribute to the ease of upward displacement of upper portion 302 and consequently inner carriage 300. At a particular point lower portion 304 and upper portion 302 contact each other and a particular level of stabilization of forces and resulting friction is attained that impacts inner carriage 300 as it displaces upward in direction D1 within housing 24. Once movement of external carriage 32 is terminated, movement of inner carriage 300 terminates. Grip magnets 140, 142 of upper and lower portions 302, 304 realign, thereby re-clamping retaining strip 314 and tilt strip 28. The tilt of slats 20 may then be adjusted if desired.

The predetermined misalignment and detachment of first and second grip magnets 140, 142 in upper and lower portions 302, 304 results in the elimination of clamping forces and frictional forces associated with tilt strip 28 and retaining strip 314. Excessive friction, when slats 20 are being raised or lowered and both upper and lower portions 302, 304 are in motion, is undesirable, given too much friction may result in an unacceptable decoupling of external carriage 32 from inner carriage 300. Conversely, sufficient friction and clamping of tilt strip 28 and retaining strip 314 is required to perform the "tilt stroke" or to maintain and hold a particular adjustment when inner carriage 300 is at rest.

When the direction of movement of external carriage 32 is reversed, all external forces acting, on first and second grip magnets 140, 142 in both upper and lower portions 302, 304 are temporarily eliminated. Forces acting on floating grip magnet housings 144A, 144B cease, and magnetic coupling of corresponding grip magnets 140, 142 is re-established. The displacement required to de-couple first and second grip magnets 140, 142 in both upper and lower portions 302, 304 is predetermined to be sufficiently large to allow for the elimination of unwanted friction when actuating, the raise/lower function. Conversely, the de-coupling, displacement of first and second grip magnets 140, 142 is sufficiently small to allow enough magnetic attraction between the corresponding grip magnet pairs to facilitate magnetic re-coupling therebetween.

Although a basic aspect of the dual function control is to utilize a single knob to concurrently affect the tilt and raise & lower functions, it is important to note that the designs heretofore mentioned are versatile, and with minor changes will accommodate a variation of control methods. For example, in applications where complete isolation of the functions is desired via the utilization of two distinct and separate control knobs for the tilt and raise and lower functions, the inner and outer carriages need not be mechanically connected to achieve this result.

With relatively minor modifications to the configurations of dual function control inner carriage components described above, it is possible to provide a window unit that has a first exterior carriage for actuating the raise/lower function and a second exterior carriage for actuating the tilt function. This configuration may be appropriate for some applications such as relatively large window units, where a bifurcated control system may be desirable. As such, a larger market may be captured by addressing a variety of consumer preferences, with minimal additional tooling or new components required. In fact, inner carriage components may be designed with detachable elements, so that the inner carriage may be either mechanically attached or detached depending on the particular application. Thus, a particular requirement may determine the absence or presence of components and attachments, as well as the particular assembly configuration of the components and attachments used.

Figure 30:
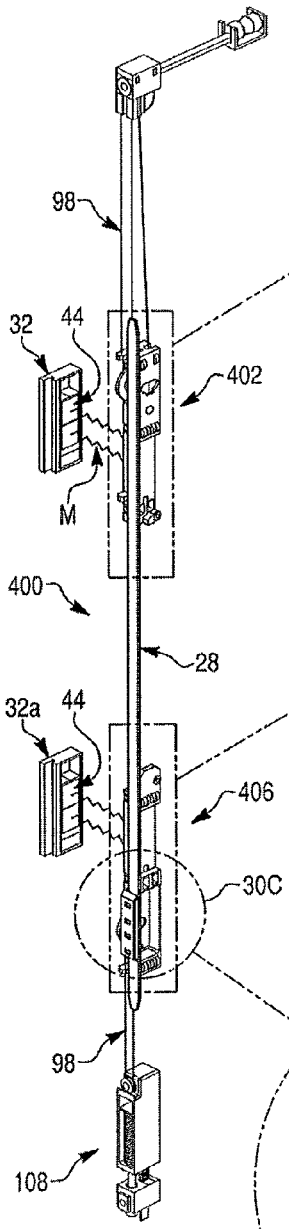
FIG. 30 is a perspective view of components of a raise/lower and tilt control mechanism according to another embodiment.
Figure 30A:
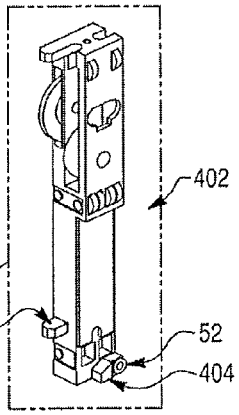
FIG. 30A is a perspective view of an inner raise and lower carriage according to the embodiment shown in FIG. 30.
Figure 30B:
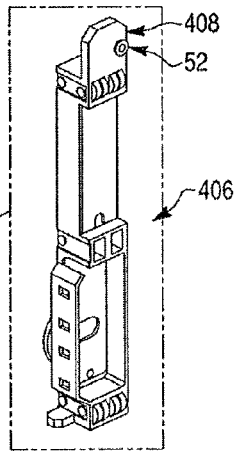
FIG. 30B is a perspective view of an inner tilt carriage, according to the embodiment shown in FIG. 30.
Figure 31:
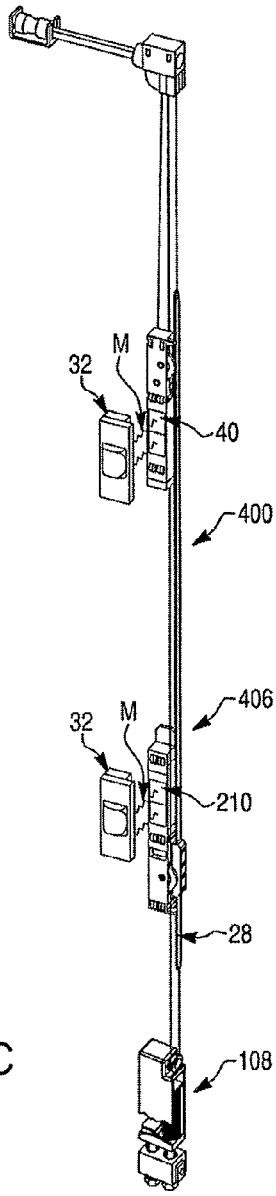
FIG. 31 is another perspective view of components of the raise/lower and tilt control mechanism of FIG. 30 viewed from another orientation.

An embodiment of a raise/lower and tilt mechanism 400 having detached upper and lower inner carriages is best shown in FIGS. 30-31. Mechanism 400 includes first exterior carriage 32, which is magnetically coupled to an inner raise and lower carriage 402. Inner raise and lower carriage 402 includes many of the same components as upper portion 202 of inner carriage 200. However, inner raise and lower carriage 402 differs from upper portion 202 in that hitch post 212 of upper portion 202 is replaced by roller post 404 which rotatably supports guide roller 52, as shown in FIG. 30A. As such, movement of inner raise and lower carriage 402 does not affect the tilt of slats 20.

Figure 30C:
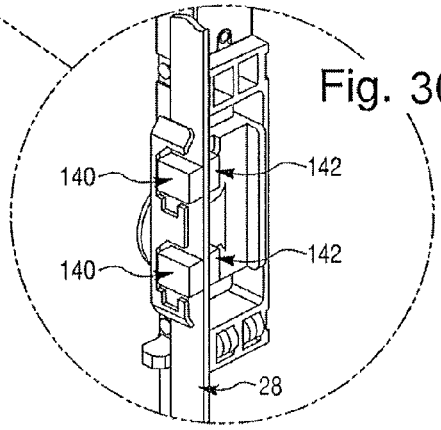
FIG. 30C is a detail view of circled portion 30C of FIG. 30.

A second exterior carriage 32A is also provided, which is identical to exterior carriage 32. However, second exterior carriage 32A is magnetically coupled to an inner tilt carriage 406. Inner tilt carriage 406 includes many of the same components as lower portion 204 of inner carriage 200, except that hitch arm 214 of lower portion 204 is replaced by roller arm 408 which rotatably supports another guide roller 52. Actuating second exterior carriage 32A causes movement of inner tilt carriage 406 via magnetic coupling, which in turn tilts slats 20 via tilt loop L, as described above. Thus, mechanism 400 includes tilt strip 28 and tilt pulley lines 98. Furthermore, the configuration of grip magnets 140, 142 and tilt strip 28 is identical to the assembly of inner carriage 200, as shown in FIG. 30C.

Given inner tilt carriage 406 is not mechanically attached to inner raise and lower carriage 402, the titling of slats 20 does not affect the raise and lower adjustment. In addition, such a configuration provides for a relatively short and precise stroke given inner tilt carriage 406 is detached from inner raise and lower carriage 402. The relatively short linear tilt stroke results from the relatively small diameter and circumference of the tilt spool and resultant linear displacement required to tilt slats 20.

Figures 32, 32A, 32B, 32C, 32D, 32E:
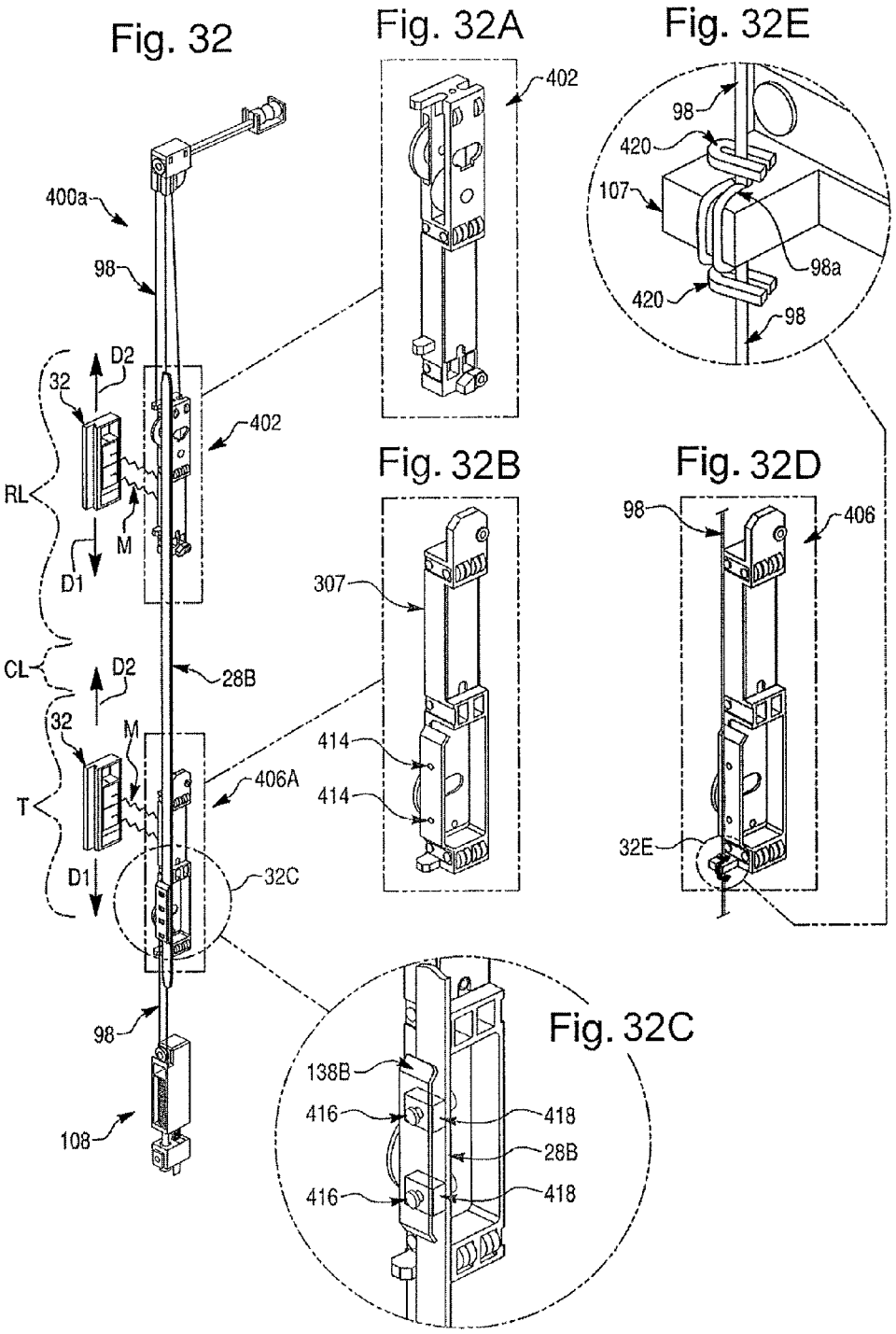
FIG. 32 is a perspective view of components of a raise/lower and tilt control mechanism according to another embodiment.
FIG. 32A is a perspective view of an inner raise and lower carriage according to the embodiment shown in FIG. 32.
FIG. 32B is a perspective view of an inner tilt carriage according to the embodiment shown in FIG. 32.
FIG. 32C is a detail view of circled portion 32C of FIG. 32.
FIG. 32D is a perspective view of an inner tilt carriage according to another embodiment.
FIG. 32E is a detail view of circled portion 32E of FIG. 32D.

Another embodiment of a raise/lower and tilt mechanism 400A having detached upper and lower inner carriages is best shown in FIGS. 32-32C. Mechanism 400A is similar to mechanism 400, with like components identified accordingly. Inner raise and lower carriage 402 and an inner tilt carriage 406A are disposed along tilt loop L within carriage housing 24. Inner raise and lower carriage 402 is actuatable in first or second directions D1, D2 a predetermined distance, shown by a raise/lower stroke RL. Inner tilt carriage 406A is actuatable in first or second directions D1, D2 by a predetermined distance, shown by a tilt stroke T. Tilt stroke T is preferably less than raise/lower stroke RL. When inner raise and lower carriage 402 is disposed at a lower most position of raise/lower stroke RL, and inner tilt carriage 406A is disposed at an uppermost position of tilt stroke T, inner raise and lower carriage 402 and inner tilt carriage 406A may be spaced by a given clearance distance CL.

Inner tilt carriage 406A is similar to inner tilt carriage 406, but includes a retaining bracket 138B that is secured to a tilt strip 28B. Tilt strip 28B may include one or more holes extending therethrough. Inner tilt carriage 406A and retaining bracket 138B may also include holes 414 which may be aligned with the holes in tilt strip 28B. Associated fasteners 416 extend through the aligned holes in inner tilt carriage 406A, retaining bracket 138B and tilt strip 28B, thereby fixedly securing tilt strip 28B to inner tilt carriage 406A, as best shown in FIGS. 32B and 32C. As such, grip magnets 140, 142 are not required in this iteration. The holes in tilt strip 28B are preferably located along the length of tilt strip 28B to accommodate a desired position corresponding to stroke T.

One or more spacers 418 may be provided intermediate retaining bracket 138B and the corresponding portion of inner tilt carriage 406A, as best shown in FIG. 32C. Spacers 418 align and locate tilt strip 28B at a desired position relative to inner tilt carriage 406A. Thus, tilt strip 28B is mechanically and rigidly attached to inner tilt carriage 406A via retaining bracket 138B. Unlike other embodiments, the particular position of inner t carriage 406A in relation to tilt strip 28B is fixed.

Other methods of securing inner tilt carriage 406A to either tilt strip 28 or another portion of tilt loop L may also be provided. For example, inner tilt carriage 406 may be provided, which is attached to tilt line 98 at a fixed position thereon, as best shown in FIGS. 32D and 32E. Tilt line 98 may be looped around guide arm 107 and/or line retaining clips 420 may be used to secure inner tilt carriage 406 to tilt line 98 at a fixed position on tilt loop L. Thus, tilt strip 28B and retaining bracket 138B may be eliminated given tilt line 98 attaches directly to inner tilt carriage 406.

Preferably, the raise and lower-tilt function of mechanism 400A provides for a relatively short tilt stroke T, which may be precisely positioned within carriage housing 24. Thus, it is advantageous to have a rigid connection between tilt loop L and inner tilt carriage 406 (or 406A). Such a connection eliminates any possible slippage of tilt strip 28 between gripping magnets 140 and 142, which may adversely affect tilt control response, and also eliminates grip magnets 140, 142, bracket 138B as well as tilt strip 28B, thereby decreasing, component and manufacturing costs.

As shown in FIGS. 30, 31 and 32, inner tilt carriage 406, 406A is located below inner raise and lower carriage 402. However, it would be understood by one skilled in the art that the inner tilt carriage 406, 406A could also be provided above the raise and lower carriage 402 if so desired.

Thus, various embodiments provide for a first knob to control the raise and lower function and a second control knob to control the tilt function. Both functions are completely independent of each other and concurrently utilize the unique properties inherent in the design. The inner and outer tilt carriages of such assemblies do not interfere with the movement of the inner and outer raise and lower carriages.

The disclosed embodiments of a window blind with dual function control overcome various problems encountered by other conventional window blinds: 1) positive and consistent tilt control is maintained, while minimizing drag on the inner and outer carriages; 2) integrity of the tilt function components is maintained even after extended usage; 3) sliding noise is reduced by providing relatively frictionless contacts; 4) the mechanism components are relatively easy to handle and assemble, and simply clip or slide into place with no threading or locking required; and 5) prolonged and smooth operation of the slide knob is achieved.

The present invention has been described herein in terms of various embodiments. Various modifications and additions to the embodiments would be apparent to those skilled in the art upon a reading of the foregoing description. In addition, features of one embodiment may be applied to another embodiment. Therefore, it is intended that all such modifications be included within the scope of this invention to the extent that they are encompassed by the following claims and their equivalents.

I claim:

1. A door comprising:

a multi-pane window having first and second spaced panes defining an interior space, and an exterior surface;

a window blind including a plurality of slats disposed within said interior space;

raise/lower lines coupled to said slats;

tilt lines coupled to said slats;

a carriage housing disposed within said interior space proximate a side edge of said multi-pane window;

a tilt strip disposed within said carriage housing and coupled to said tilt lines;

a first inner carriage disposed within said carriage housing and coupled to said tilt strip to actuate upwardly tilting said slats when moved in a first direction and downwardly tilting said slats when moved in a second direction, said first inner carriage including a first inner carriage magnet;

a second inner carriage disposed within said carriage housing and coupled to said raise/lower lines to actuate raising said slats when moved in said first direction and lowering said slats when moved in said second direction, said second inner carriage including a second inner carriage magnet;

a first external magnet adjacent said exterior surface and aligned with and magnetically coupled to said first inner carriage magnet, said first external magnet linearly moveable to move said first inner carriage; and a second external magnet adjacent said exterior surface and aligned with and magnetically coupled to said second inner carriage magnet, said second external magnet linearly moveable to move said second inner carriage, wherein said first inner carriage further comprises a first grip magnet magnetically coupled to a second grip magnet.

2. The door of claim 1, wherein said tilt strip de-couples from and slides between said first and second grip magnets when a force is applied to said first inner carriage in one of said first and second directions that exceeds a threshold level during movement of said first inner carriage.

3. The door of claim 2, wherein said first inner carriage is moveably connected to said second inner carriage.

4. The door of claim 3, wherein one of said first and second inner carriages includes a hitch post receivable in a hitch slot provided in the other of said first and second inner carriages, said hitch post slidably received in said hitch slot so that said first inner carriage is moveably spaced from said second inner carriage.

5. The door of claim 3, further comprising an external slide knob having a lower chamber configured for housing said first external magnet, and an upper chamber configured for housing said second external magnet.

6. The door of claim 5, wherein said second external magnet is slidably disposed within said upper chamber in said first and second directions, so that said first external magnet is moveable a predetermined distance in said first and second directions while maintaining said second external magnet in a fixed position.

7. The door of claim 3, further comprising a retaining strip secured to said carriage housing, wherein said second inner carriage includes a third grip magnet magnetically coupled to a fourth grip magnet, said retaining strip disposed and secured between said third and fourth grip magnets, said second inner carriage maintained at a predetermined position along said retaining strip until a predetermined threshold force in one of said first and second directions is exceeded during movement of said second inner carriage.

8. The door of claim 2, further comprising a first external slide knob having a chamber configured for housing said first external magnet, and a second external slide knob having a chamber configured for housing said second external magnet.

9. The door of claim 1, further comprising tilt pulley lines coupled to said tilt strip, wherein said first inner carriage is secured to one of said tilt pulley lines and said tilt strip at a fixed position, said tilt strip moveable in said first and second directions when said first inner carriage is moved.

10. A door comprising:

a multi-pane window having first and second spaced panes defining an interior space, and an exterior surface;

a window blind including a plurality of slats disposed within said interior space;

raise/lower lines coupled to said slats;

tilt lines coupled to said slats;

a carriage housing disposed within said interior space proximate a side edge of said multi-pane window;

a tilt strip disposed within said carriage housing and coupled to said tilt lines;

a first inner carriage disposed within said carriage housing and coupled to said tilt strip to actuate upwardly tilting said slats when moved in a first direction and downwardly tilting said slats when moved in a second direction, said first inner carriage including a first inner carriage magnet;

a second inner carriage disposed within said carriage housing and coupled to said raise/lower lines to actuate raising said slats when moved in said first direction and lowering said slats when moved in said second direction, said second inner carriage including a second inner carriage magnet;

an external carriage adjacent said exterior surface and aligned with and magnetically coupled to at least one of said first and second inner carriage magnets;

a plurality of magnetic assemblies comprising a plurality of movable magnets maintained in a cooperating relationship with each other and being operable to provide a floating magnetic couple between said inner and external carriages when moved in said first and second directions;

tilt pulley lines coupled to said tilt strip, wherein said first inner carriage is secured to one of said tilt pulley lines and said tilt strip at a fixed position, said tilt strip moveable in said first and second directions when said first inner carriage is moved;

a first external slide knob having a chamber configured for housing a first external magnet of said plurality of magnetic assemblies; and a second external slide knob having a chamber configured for housing a second external magnet of said plurality of magnetic assemblies, said first external slide knob moveable a first predetermined distance in said first and second directions, and said second external slide knob moveable in a second predetermined distance in said first and second directions.

11. The door of claim 10, wherein said first distance is less than said second distance.

12. The door of claim 10, further comprising:

a tilt rod proximate a top edge of said multi-pane window and coupled to said tilt lines;

at least one cradle assembly rotatably supporting said tilt rod; and a tilt drive spool coupled to said tilt rod, said tilt drive spool disposed proximate a corner of said multi-pane window intermediate said side edge and said top edge, wherein said tilt drive spool is coupled to said tilt strip so that movement of said tilt strip rotates said tilt drive spool thereby transmitting rotational torque to said tilt rod for tilting said slats.

13. The door of claim 12, further comprising a tilt drive bar disposed between and coupling said tilt drive spool and a corresponding end of said tilt rod.

14. The door of claim 12, wherein said tilt drive spool is coupled to said tilt strip via first and second spaced tilt pulleys and a tilt pulley line, said first tilt pulley connected to said tilt drive spool and said second tilt pulley disposed along said side edge, said tilt pulley line wound around said first and second tilt pulleys and connected to opposite ends of said tilt strip to form a closed loop.

15. The door of claim 14, further comprising a tilt bracket configured for housing said tilt drive spool, said tilt drive spool rotatable therein.

16. A door comprising:

a multi-pane window having first and second spaced panes defining an interior space, and an exterior surface;

a window blind including a plurality of slats disposed within said interior space;

raise/lower lines coupled to said slats;

tilt lines coupled to said slats;

a carriage housing disposed within said interior space proximate a side edge of said multi-pane window;

a tilt strip disposed within said carriage housing and coupled to said tilt lines;

a first inner carriage disposed within said carriage housing and coupled to said tilt strip to actuate upwardly tilting said slats when moved in a first direction and downwardly tilting said slats when moved in a second direction, said first inner carriage including a first inner carriage magnet;

a second inner carriage disposed within said carriage housing and coupled to said raise/lower lines to actuate raising said slats when moved in said first direction and lowering said slats when moved in said second direction, said second inner carriage including a second inner carriage magnet;

a tilt rod proximate a top edge of said multi-pane window and coupled to said tilt lines;

at least one cradle assembly rotatably supporting said tilt rod;

a tilt drive spool coupled to said tilt rod, said tilt drive spool disposed proximate a corner of said multi-pane window intermediate said side edge and said top edge, wherein said tilt drive spool is coupled to said tilt strip so that movement of said tilt strip rotates said tilt drive spool thereby transmitting rotational torque to said tilt rod for tilting said slats, and wherein said tilt drive spool is coupled to said tilt strip via first and second spaced tilt pulleys and a tilt pulley line, said first tilt pulley connected to said tilt drive spool and said second tilt pulley disposed along said side edge, said tilt pulley line wound around said first and second tilt pulleys and connected to opposite ends of said tilt strip to form a closed loop; and a tilt bracket configured for housing said tilt drive spool, said tilt drive spool rotatable therein, wherein said tilt drive spool includes a rotation limiting stem engageable with a contact boss disposed on said tilt bracket, wherein rotation of said tilt drive spool is restricted when said rotation limiting stem engages said contact boss.

17. A door comprising:

a multi-pane window having first and second spaced panes defining an interior space, and an exterior surface;

a window blind including a plurality of slats disposed within said interior space;

raise/lower lines coupled to said slats;

tilt lines coupled to said slats;

a carriage housing disposed within said interior space proximate a side edge of said multi-pane window;

a tilt strip disposed within said carriage housing and coupled to said tilt lines;

a first inner carriage disposed within said carriage housing and coupled to said tilt strip to actuate upwardly tilting said slats when moved in a first direction and downwardly tilting said slats when moved in a second direction, said first inner carriage including a first inner carriage magnet;

a second inner carriage disposed within said carriage housing and coupled to said raise/lower lines to actuate raising said slats when moved in said first direction and lowering said slats when moved in said second direction, said second inner carriage including a second inner carriage magnet;

a tilt rod proximate a top edge of said multi-pane window and coupled to said tilt lines;

at least one cradle assembly rotatably supporting said tilt rod;

a tilt drive spool coupled to said tilt rod, said tilt drive spool disposed proximate a corner of said multi-pane window intermediate said side edge and said top edge, wherein said tilt drive spool is coupled to said tilt strip so that movement of said tilt strip rotates said tilt drive spool thereby transmitting rotational torque to said tilt rod for tilting said slats, and wherein said tilt drive spool is coupled to said tilt strip via first and second spaced tilt pulleys and a tilt pulley line, said first tilt pulley connected to said tilt drive spool and said second tilt pulley disposed along said side edge, said tilt pulley line wound around said first and second tilt pulleys and connected to opposite ends of said tilt strip to form a closed loop;

a tension pulley housing and a retaining block, said tension pulley housing connected to and moveably spaced from said retaining block via a first tension bolt, said second tilt pulley disposed on said tension pulley housing;

a spring retained on a stem of said first tension bolt, said tension pulley housing biased toward said retaining block via said spring so that a predetermined level of tension on said closed loop is maintained; and a second tension bolt disposed between and connecting said tension pulley housing and said retaining block, said second tension bolt defining a maximum axial displacement between said tension pulley housing and said retaining block.

18. A door comprising:

a multi-pane window having first and second spaced panes defining an interior space, and an exterior surface;

a window blind including a plurality of slats disposed within said interior space;

raise/lower lines coupled to said slats;

tilt lines coupled to said slats;

a carriage housing disposed within said interior space proximate a side edge of said multi-pane window;

a tilt strip disposed within said carriage housing and coupled to said tilt lines;

a first inner carriage disposed within said carriage housing and coupled to said tilt strip to actuate upwardly tilting said slats when moved in a first direction and downwardly tilting said slats when moved in a second direction, said first inner carriage including a first inner carriage magnet;

a second inner carriage disposed within said carriage housing and coupled to said raise/lower lines to actuate raising said slats when moved in said first direction and lowering said slats when moved in said second direction, said second inner carriage including a second inner carriage magnet;

a tilt rod proximate a top edge of said multi-pane window and coupled to said tilt lines;

at least one cradle assembly rotatably supporting said tilt rod;

a tilt drive spool coupled to said tilt rod, said tilt drive spool disposed proximate a corner of said multi-pane window intermediate said side edge and said top edge, wherein said tilt drive spool is coupled to said tilt strip so that movement of said tilt strip rotates said tilt drive spool thereby transmitting rotational torque to said tilt rod for tilting said slats, and wherein said tilt drive spool is coupled to said tilt strip via first and second spaced tilt pulleys and a tilt pulley line, said first tilt pulley connected to said tilt drive spool and said second tilt pulley disposed along said side edge, said tilt pulley line wound around said first and second tilt pulleys and connected to opposite ends of said tilt strip to form a closed loop; and a tension pulley housing and a retaining block, said tension pulley housing connected to and moveably spaced from said retaining block via a first tension bolt, said second tilt pulley disposed on said tension pulley housing, wherein said tension pulley housing includes a ratchet arm extending outwardly therefrom, said ratchet arm engageable and cooperating with a locking lever disposed on said retaining block, said ratchet arm permitting downward movement of said tension pulley housing toward said retaining block while prohibiting upward movement of said tension pulley housing past said locking lever.

* * * * *